US008777037B2

(12) United States Patent
Knopow et al.

(10) Patent No.: US 8,777,037 B2
(45) Date of Patent: Jul. 15, 2014

(54) CONTAINER FOR A DISPENSER

(75) Inventors: Jeremy F. Knopow, Burlington, WI (US); Jeffrey L. Crull, McFarland, WI (US); Lawrence J. Fenske, Madison, WI (US); Cunjiang Cheng, Madison, WI (US); Cory J. Nelson, Racine, WI (US); Jose M. Arevalo, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 1050 days.

(21) Appl. No.: 12/817,847

(22) Filed: Jun. 17, 2010

(65) Prior Publication Data

US 2010/0282776 A1 Nov. 11, 2010

Related U.S. Application Data

(63) Continuation-in-part of application No. 12/450,383, filed as application No. PCT/US2008/003926 on Mar. 26, 2008.

(60) Provisional application No. 61/187,945, filed on Jun. 17, 2009.

(51) Int. Cl.

| | |
|---|---|
| ***B05B 11/00*** | (2006.01) |
| ***B05B 15/06*** | (2006.01) |
| ***B05B 12/14*** | (2006.01) |
| ***B67D 7/02*** | (2010.01) |
| ***B05B 7/24*** | (2006.01) |
| ***B65D 83/68*** | (2006.01) |
| ***B67D 7/74*** | (2010.01) |
| ***B67D 7/00*** | (2010.01) |
| *B65D 83/60* | (2006.01) |

(52) U.S. Cl.

CPC ..... *B05B 11/0078* (2013.01); *B67D 7/02* (2013.01); *B67D 7/0238* (2013.01); *B05B 7/2472* (2013.01); *B65D 83/68* (2013.01); *B67D 7/74* (2013.01); *B67D 7/0288* (2013.01); *B67D 7/0205* (2013.01); *B05B 12/14* (2013.01); *B05B 11/3057* (2013.01); *B67D 7/005* (2013.01); *B05B 7/2443* (2013.01); *B05B 11/00* (2013.01); *B05B 11/0054* (2013.01); *B65D 83/60* (2013.01)

USPC ..... 220/23.89; 220/500; 220/600; 220/669; 220/676; 222/129; 222/136; 222/372; 222/192; 222/144.5; 222/144; 239/214; 239/302; 239/303; 239/307; 239/308; 239/433; 239/264; 239/61; 211/78; 211/77; 134/172

(58) Field of Classification Search

USPC ..... 220/23.89, 525, 502; 239/214, 239/303–308, 526, 433, 337, 264, 379; 222/136, 144.5, 375, 382, 385; 312/270.2, 212, 305; 211/78, 77, 115; D9/739, 743, 522, 523, 541, 563; D23/225, 213; 134/123, 172, 201

See application file for complete search history.

(56) References Cited

U.S. PATENT DOCUMENTS

| | | | | |
|---|---|---|---|---|
| 146,783 | A * | 1/1874 | Richardson | 215/10 |
| 912,106 | A * | 2/1909 | Frazier | 239/305 |

(Continued)

FOREIGN PATENT DOCUMENTS

| | | | |
|---|---|---|---|
| DE | 4242009 | A1 | 6/1994 |
| DE | 29722224 | U1 | 2/1998 |

(Continued)

OTHER PUBLICATIONS

US 7,568,596, 8/2009, Laidler et al. (withdrawn).

*Primary Examiner* — Mickey Yu
*Assistant Examiner* — Gideon Weinerth

(57) ABSTRACT

A device 10 for selectively dispensing ones of multiple fluids, preferably cleaning agents, is disclosed. The device includes a reservoir 50 that holds a diluent "D" therein and a housing 20 that includes a main body segment 22 and a head segment 26. A container assembly 100 may be held between the main body and head segments 22, 26. The container assembly may include at least one container body 105, 110, 112, 114, 116. Each container body 105, 110, 112, 114, 116 houses a concentrate "C," for example, a concentrated form of a cleaning or other agent therein. The diluent "D" and concentrates "C" are kept separate from each other, whereby no end use product is stored in the device 10. Instead, end use product is mixed on demand during dispensation.

4 Claims, 28 Drawing Sheets

(56) References Cited

U.S. PATENT DOCUMENTS

| | | | | | |
|---|---|---|---|---|---|
| D62,160 | S | * | 3/1923 | Wipf | D9/522 |
| 1,863,782 | A | * | 6/1932 | Young | 137/255 |
| 1,948,401 | A | * | 2/1934 | Smith et al. | 137/255 |
| D91,742 | S | * | 3/1934 | Tarr | D9/739 |
| 1,977,092 | A | * | 10/1934 | Scurlock | 211/77 |
| 2,030,899 | A | * | 2/1936 | Scurlock | 211/77 |
| 2,091,394 | A | * | 8/1937 | Park | 211/77 |
| 2,655,288 | A | * | 10/1953 | Caretto | 222/142.3 |
| 2,811,391 | A | * | 10/1957 | Krebs | 239/332 |
| 3,003,703 | A | | 10/1961 | Lambton | |
| 3,135,467 | A | * | 6/1964 | Greenman | 239/304 |
| 3,187,757 | A | * | 6/1965 | Jones, Jr. et al. | 132/314 |
| 3,235,130 | A | * | 2/1966 | Waither et al. | 222/142.9 |
| 3,298,611 | A | | 1/1967 | Marraffino et al. | |
| 3,385,465 | A | * | 5/1968 | Bliss | 220/23.4 |
| 3,506,001 | A | * | 4/1970 | Costello | 128/200.14 |
| 3,767,087 | A | * | 10/1973 | Shannon | 222/144.5 |
| 3,779,245 | A | * | 12/1973 | Windsor | 604/300 |
| 4,162,037 | A | * | 7/1979 | Koyama | 239/332 |
| 4,165,812 | A | * | 8/1979 | Jennison | 215/10 |
| 4,194,619 | A | * | 3/1980 | Schley | 206/217 |
| 4,355,739 | A | * | 10/1982 | Vierkotter | 222/134 |
| D281,824 | S | * | 12/1985 | Field | D28/76 |
| 4,609,106 | A | | 9/1986 | Gentili | |
| D319,126 | S | * | 8/1991 | Blackman | D34/7 |
| 5,152,431 | A | * | 10/1992 | Gardner et al. | 222/136 |
| 5,152,461 | A | * | 10/1992 | Proctor | 239/304 |
| D336,846 | S | * | 6/1993 | Proctor | D9/684 |
| 5,244,270 | A | * | 9/1993 | Parker | 312/270.2 |
| D354,909 | S | * | 1/1995 | Blanche | D9/739 |
| 5,398,846 | A | * | 3/1995 | Corba et al. | 222/1 |
| 5,439,141 | A | | 8/1995 | Clark et al. | |
| D363,020 | S | * | 10/1995 | Mason et al. | D9/741 |
| 5,529,216 | A | | 6/1996 | Klima et al. | |
| D376,955 | S | * | 12/1996 | Petrosyan et al. | D7/598 |
| 5,740,947 | A | * | 4/1998 | Flaig et al. | 222/135 |
| 5,788,125 | A | | 8/1998 | Steiner et al. | |
| 5,836,479 | A | | 11/1998 | Klima et al. | |
| D404,302 | S | * | 1/1999 | Martin | D9/743 |
| 5,871,122 | A | | 2/1999 | Klima et al. | |
| 5,890,624 | A | | 4/1999 | Klima et al. | |
| 5,906,318 | A | | 5/1999 | Gurko, III et al. | |
| 5,947,332 | A | | 9/1999 | Klima, Jr. et al. | |
| 5,994,223 | A | | 11/1999 | Kim | |
| 6,073,808 | A | | 6/2000 | Klima et al. | |
| 6,095,362 | A | * | 8/2000 | Shui-Shang | 220/23.4 |
| 6,123,230 | A | | 9/2000 | Klima, Jr. et al. | |
| 6,152,326 | A | | 11/2000 | Klima, Jr. et al. | |
| 6,182,839 | B1 | * | 2/2001 | Robbins et al. | 211/78 |
| 6,182,865 | B1 | | 2/2001 | Bunschoten et al. | |
| D439,156 | S | * | 3/2001 | Hall et al. | D9/743 |
| D447,304 | S | * | 8/2001 | Niemeyer | D34/1 |
| 6,279,836 | B1 | | 8/2001 | Toetschinger et al. | |
| 6,319,453 | B1 | | 11/2001 | Klima, Jr. et al. | |
| 6,375,041 | B1 | | 4/2002 | Klima et al. | |
| 6,431,402 | B1 | | 8/2002 | Klima et al. | |
| 6,431,468 | B1 | | 8/2002 | Brown et al. | |
| 6,540,109 | B1 | | 4/2003 | Klima et al. | |
| 6,568,562 | B1 | | 5/2003 | Klima, Jr. et al. | |
| 6,659,311 | B2 | | 12/2003 | Prueter | |
| D497,975 | S | * | 11/2004 | Chen | D23/225 |
| D512,329 | S | * | 12/2005 | Akopyan | D9/739 |
| D514,953 | S | * | 2/2006 | Akopyan | D9/739 |
| D515,428 | S | * | 2/2006 | Abadinsky | D9/522 |
| D519,382 | S | * | 4/2006 | Cowgill | D9/561 |
| D521,390 | S | * | 5/2006 | Andoh | D9/542 |
| 7,100,843 | B2 | | 9/2006 | Boticki et al. | |
| 7,104,467 | B2 | | 9/2006 | Crossdale et al. | |
| 7,124,962 | B1 | * | 10/2006 | Fryan et al. | 239/318 |
| 7,147,172 | B2 | | 12/2006 | Darling, III et al. | |
| 7,156,226 | B1 | * | 1/2007 | Van Sickle | 206/216 |
| 7,168,629 | B2 | | 1/2007 | Timmes et al. | |
| D542,417 | S | * | 5/2007 | Larsen | D24/204 |
| 7,222,802 | B2 | | 5/2007 | Sweeton | |
| 7,228,991 | B2 | * | 6/2007 | Barraclough | 222/144.5 |
| 7,243,676 | B2 | | 7/2007 | Bailey | |
| 7,294,264 | B2 | * | 11/2007 | Wooton et al. | 210/236 |
| 7,302,971 | B2 | | 12/2007 | Myntti | |
| 7,303,149 | B1 | * | 12/2007 | Huang | 239/332 |
| 7,331,486 | B2 | | 2/2008 | Mon et al. | |
| 7,331,488 | B2 | | 2/2008 | Naslund et al. | |
| 7,370,813 | B2 | | 5/2008 | Hubmann et al. | |
| 7,448,556 | B2 | | 11/2008 | Muehlhausen et al. | |
| 7,478,738 | B2 | | 1/2009 | Hood et al. | |
| 7,565,988 | B2 | | 7/2009 | Foster | |
| 7,581,662 | B2 | * | 9/2009 | Powell | 222/401 |
| 7,654,415 | B2 | * | 2/2010 | van der Heijden | 222/135 |
| D619,465 | S | * | 7/2010 | Synder | D9/522 |
| 7,789,278 | B2 | | 9/2010 | Ruiz de Gopegui et al. | |
| 7,793,678 | B2 | | 9/2010 | Edwards et al. | |
| 7,837,132 | B2 | * | 11/2010 | Mazooji et al. | 239/263.1 |
| 7,926,682 | B2 | * | 4/2011 | Nelson et al. | 222/130 |
| D644,715 | S | * | 9/2011 | Woodling | D23/225 |
| D647,998 | S | * | 11/2011 | Nelson et al. | D23/225 |
| 8,074,825 | B1 | * | 12/2011 | Ziegler | 220/523 |
| D661,373 | S | * | 6/2012 | Moodycliffe et al. | D23/225 |
| 8,413,849 | B2 | * | 4/2013 | Flores | 222/153.13 |
| 8,418,936 | B2 | * | 4/2013 | Schaeffer et al. | 239/333 |
| D686,695 | S | * | 7/2013 | Moodycliffe et al. | D23/225 |
| 8,596,498 | B2 | * | 12/2013 | Werner et al. | 222/136 |
| 2002/0117558 | A1 | | 8/2002 | Timmes et al. | |
| 2002/0170981 | A1 | | 11/2002 | Decker et al. | |
| 2003/0038186 | A1 | | 2/2003 | Klima et al. | |
| 2004/0149775 | A1 | * | 8/2004 | Chen | 222/135 |
| 2005/0284963 | A1 | * | 12/2005 | Reedy | 239/526 |
| 2010/0006671 | A1 | * | 1/2010 | Seabase et al. | 239/327 |
| 2010/0072300 | A1 | * | 3/2010 | Miller et al. | 239/332 |
| 2010/0132814 | A1 | | 6/2010 | Schiller et al. | |
| 2012/0104037 | A1 | * | 5/2012 | Ben-Shoshan | 222/1 |
| 2013/0121878 | A1 | * | 5/2013 | Wilson et al. | 422/68.1 |
| 2014/0034754 | A1 | * | 2/2014 | Thompson et al. | 239/332 |
| 2014/0076930 | A1 | * | 3/2014 | Werner et al. | 222/132 |

FOREIGN PATENT DOCUMENTS

| | | | |
|---|---|---|---|
| EP | 1726532 | | 11/2006 |
| WO | 9530491 | A1 | 11/1995 |
| WO | WO9530491 | | 11/1995 |
| WO | WO2006043935 | | 4/2006 |
| WO | WO2006058433 | | 6/2006 |
| WO | WO2006105574 | | 10/2006 |
| WO | WO2007001488 | | 1/2007 |
| WO | WO2008010169 | | 1/2008 |
| WO | WO2008014833 | | 2/2008 |
| WO | WO2008076941 | | 6/2008 |
| WO | WO2008104029 | | 9/2008 |
| WO | WO2008112737 | | 9/2008 |
| WO | 2008118446 | A2 | 10/2008 |
| WO | WO2009007657 | | 1/2009 |
| WO | WO2009049316 | | 4/2009 |
| WO | WO2009058230 | | 5/2009 |

* cited by examiner

CONTAINER FOR A DISPENSER

CROSS-REFERENCE TO RELATED APPLICATIONS

This utility patent application claims the benefit of and priority to U.S. provisional application 61/187,945, filed Jun. 17, 2009, and is a continuation-in-part of and claims the benefit of and priority to currently pending U.S. application Ser. No. 12/450,383, filed Dec. 15, 2009 as a national phase application of PCT application PCT/US2008/003926, filed Mar. 26, 2008, which claims the benefit of and priority to U.S. provisional application 60/908,312, filed Mar. 27, 2007; U.S. provisional application 60/946,848, filed Jun. 28, 2007; and U.S. provisional application 60/990,186, filed Nov. 26, 2007; each of which is herein expressly incorporated by reference in its entirety, for all purposes.

BACKGROUND OF THE INVENTION

1. Field of the Invention

The present invention relates to chemical dispensation devices and, more specifically, to a device for selectively dispensing ones of a variety of liquid-based, foam, and/or gel-type chemical compositions.

2. Discussion of the Related Art

In typical households, residences, and other domestic dwellings, as well as within commercial and business buildings, many chemical cleaning agents are used in performing numerous common home cleaning, freshening, or other maintenance tasks. In a given area within a household, for example, within a single room, more than one cleaning agent can be used during a single cleaning session.

Accordingly, users of chemical cleaning agents occasionally must tote or carry around multiple containers of different chemical cleaning agents. In the alternative to transporting multiple chemical cleaning agents, the user is required to make multiple trips between the pieces being cleaned and, for example, the area where the cleaning agents are stored to exchange previously used agents for those which will be used subsequently.

While some cleaning tasks are performed at or near the location where chemical cleaning agents are stored, the user is still required to handle numerous individual products. As one example, many individuals keep or store various cleaning supplies within bathrooms, and bathroom cleaning typically requires the use of numerous chemical cleaning agents. Although such cleaning supplies might be stored within the bathroom, the user is still required to handle, use, manipulate, and switch between the various individual products.

Therefore, it is desirable to develop a dispensing device that can selectively dispense more than one cleaning agent, enabling a user to employ a single device for dispensing and using a variety of cleaning agents. Previous attempts to solve this problem include devices that allow for multiple end-use products to be dispensed through a single valve. For example, U.S. Pat. Nos. 3,298,611 and 4,595,127 disclose variations of an aerosol can delivery system that selectively allows one of multiple fluids to be dispensed through a single spray nozzle. Disadvantages of this technology are that multiple end-use products are dispensed through a single nozzle and there is potential for cross-contamination as the user switches between products. Also, including multiple products in a single container will either increase the size and weight of the dispensing container with each end-use product included or the volume of each product will be reduced, resulting in more frequent refills or replacements of the dispensing container.

Therefore, it is also desirable to provide a dispensing device which includes multiple, replaceable, concentrated cleaning chemistries for use with a single diluent dispenser. Other attempts have focused on providing a single replaceable, concentrated chemistry for use with a single solvent. For example, it is known to allow for a bottle to be refilled multiple times by providing cartridges containing a concentrated agent. The concentrated agent is delivered by one of several means into the bottle wherein it is combined with a solvent, preferably water, to create the usable product. While these references allow for multiple combinations of cartridges and solutions, concentrated or not, to be used in refilling the bottle, the primary disadvantage with this system is that the concentrate and the solution are entirely combined prior to use within the bottle. This allows the bottle to be used to dispense only a single solution at any particular time. Further, the entire contents of the bottle must be dispensed or disposed of prior to using a different chemistry within the bottle.

Attempts at providing replaceable cartridges demonstrated numerous obstacles to implementing such technology on a large scale. It has proven difficult to provide adequate sealing configurations between concentrate cartridges and devices, while maintaining reasonable production costs.

It has also proven difficult to properly vent and control flow of concentrated chemistries from containers, while maintaining reasonable production costs and product size and weight, since multiple check valves and vents are often required per container. Each of the multiple check valves and vents adds an additional component to the overall device, a procedural step for its installation while manufacturing, cost of such components, and weight to the device.

Yet other difficulties arise from trying to establish a desired mix ratio of diluent to concentrate in a manually pumped or actuated spraying device. That is because in manually pumped devices, relatively small total volumes of dispensed fluid are released per pump or actuation event. Intuitively, as a total volume of dispensed fluid decreases, so also do the volumes of its concentrate and diluent constituents. Accordingly, fluid mixtures that have a low per/volume percentage of concentrate may require only a minute amount of the concentrate to arrive at the desired per/volume percentage during dispensation. Manufacturing dispensing devices that can suitably draw minute amounts of concentrate and mix it with small volumes of diluent is difficult to do while maintaining reasonable production costs. This is especially the case in venturi-based mixing systems, noting that even slight modifications in venturi configuration(s) can dramatically influence flow characteristics of fluids traveling therethrough.

Yet another problem resulting from venture-based mixing systems which are powered by a manually pumped or actuated spraying device is that each pump or actuation event includes (i) a pressure buildup phase, (ii) a maximum pressure phase, and (iii) a pressure decrease phase. Portions of the pressure buildup and decrease phases can at times be insufficient to suitably propel contents from a discharge nozzle, whereby the contents may drip out of the nozzle and run down the device. Such occurrences are commonly referred to as "drooling" and can leave a sticky or otherwise undesirable residue on the device.

There are no known readily manufacturable or commercially available prior art dispensers that allow multiple, replaceable, concentrated cleaning chemistries to be selectively used with a single diluent dispenser. What is therefore needed is a chemical or end product dispensing device which dispenses multiple cleaning agents from separate output nozzles to mitigate the likelihood of cross-contaminating the various chemistries and reduce the dependency on multiple dispensing devices for dispensing multiple end use products.

SUMMARY AND OBJECTS OF THE INVENTION

Consistent with the foregoing, and in accordance with the invention as embodied and broadly described herein, a dispensing device and container assemblies for use with the dispensing device are disclosed in suitable detail to enable one of ordinary skill in the art to make and use the invention.

According to a first embodiment of the present invention, a handheld device is presented for dispensing one or multiple end use products, preferably multiple cleaning solutions. The device includes a housing that may have a main body segment, a handle, and a head segment. A container that holds a concentrate may be retained between upper and lower surfaces of the main body and head segments, respectively. A resilient member can be provided between the container and one of the main body head segments, wherein the resilient member biases the container toward the other one of the main body and head segments, holding the container in place.

In some embodiments, a rotating frame extends between the main body and head segments. The rotating frame can include (i) a bottom wall, and (ii) an outlet assembly overlying at least part of the bottom wall. A void space defined between the outlet assembly and the bottom wall of the rotating frame removably receives the container therein. In some embodiment, the resilient member is provided on the bottom wall of the rotating frame. The resilient member can be configured as a flexible tab that provided on the bottom wall of the rotating frame, the flexible tab biasing the container against the outlet assembly of the rotating frame. The flexible tab can resiliently pivot about an axis defined by a line of attachment between the flexible tab and the bottom wall of the rotating frame. The flexible tab can have a ramped projection extending upwardly therefrom, with front and back surfaces that converge at an upper transversely extending peak.

In some embodiments, a concentrate holding container is provided with a lower locking receptacle that extends into its lower wall. At least a portion of the flexible tab can insert into the lower locking receptacle of the container lower wall.

In yet other embodiments, the device includes an out assembly that has a locking projection extending downwardly therefrom. The upper locking receptacle can define an arcuate surface extending into the upper wall of the container. Furthermore, the upper locking receptacle can define a length, a width, and a depth, and a magnitude of least one of the width and depth varies along the length of the upper locking receptacle. For example, the width of the upper locking receptacle may vary along the length thereof, such that a widest portion of the upper locking receptacle is defined at a position located part-way along the length of the upper locking receptacle. As another example, the depth of the locking receptacle may vary along the width thereof, such that a deepest portion of the upper locking receptacle is defined at a position located part-way along the width of the upper locking receptacle.

In some embodiments, a cylindrical projection extends axially upward from an upper wall of the container. The cylindrical projection can be provided concentrically within a collar, such that the collar and cylindrical projection define an annular channel therebetween.

In yet other embodiments, a lower wall has a lower locking receptacle that is spaced a relatively greater distance from the front wall than a distance defined between the upper locking receptacle and the front wall. The collar of the container upper wall can at least partially overlie the lower locking receptacle of the lower wall. Furthermore, the lower locking receptacle can include a ramped upper wall extending angularly thereinto. In some embodiments, a portion of the lower locking receptacle that is nearest the front wall of the container is relatively wider than a portion of the locking receptacle that is furthest from the front wall. In further embodiments, the front wall of the container has a waist portion with a smaller width dimension, as compared to other portions of the front wall.

In some embodiments, the locking projection can insert into an upper locking receptacle of an upper wall of the container, wherein the locking projection retains an upper portion of the container so that is rotates in unison with a carousel or rotating frame of the device, resisting torsional removal forces. The rotating frame can define an axis of rotation that is generally upright and tilting forward. In this configuration, an upper portion of the rotating frame leans away from the handle, when the dispenser sits upon an underlying horizontal support surface.

In another family of embodiments, the invention comprehends a venturi assembly having a venturi body that includes a minimum diameter segment. An uptake tube is fluidly connected to and extending radially from the minimum diameter segment. An inlet segment is fluidly connected to and extending axially from a first end of the minimum diameter segment. An outlet segment is fluidly connected to and extending axially from a second, opposing, end of the minimum diameter segment and a nozzle assembly attached to an end of the outlet segment that is furthest from the minimum diameter segment. The inlet segment can be shorter than the outlet segment. The nozzle assembly has a swirl chamber and a valve body with a valve end and an opposing plug end. The valve end of the valve is adjacent the outlet segment of the venturi body and the plug end of the valve body being adjacent the swirl chamber. A nozzle, having an opening extending therethrough, is provided adjacent to and directs contents from the swirl chamber, out of the nozzle assembly.

In some embodiments, the plug end of the valve body at least partially defines a back wall of the swirl chamber, separating the swirl chamber from other portions of the nozzle assembly. The valve body can include a one-way valve configured to selectively allow fluid flow out of the nozzle of the venturi assembly.

In yet another family of embodiments, each container includes a valve assembly. The valve assembly preferably includes a valve body, a cap, and a dip tube. The valve body includes an outer periphery extending generally around a central axis from a first end to a second end opposite the first end. A lower surface is connected to the outer periphery at the first end and has an opening extending through the lower surface. An inner periphery extends generally around the central axis from the opening in the lower surface and up through the valve body to a slit portion establishing a fluid path through the valve body. A flange is connected to the outer periphery at the second end and extends radially outward. The valve body also includes an annular recess between the outer periphery and the inner periphery. The annular recess extends generally around the central axis and down from the second end for a portion of the length of the valve body.

As another aspect of the invention, the flange on the valve assembly has an inner periphery and an outer periphery. A curved portion of the flange forms a concave surface and connects the inner and outer peripheries.

As another aspect of the invention, the inner periphery of the valve assembly may extend generally parallel to the central axis beyond the second end of the outer periphery. Opposite sides of the inner periphery may taper toward the slit portion, forming a duck bill valve.

As another aspect of the invention, the annular recess includes a first wall extending from the second end generally into the valve body, and a second wall that is spaced a first width from the first wall and extends from the second end generally into the valve body. A channel along the inner portion of the recess connects the first and second wall and has a second width greater than the first width.

The cap engages the valve body and preferably includes a lower portion configured to extend into the annular recess of the valve body. The cap can further include a vent portion connected to a lower portion and extending radially away from the central axis. The vent portion is adjacent to the flange of the valve body and has at least one hole extending therethrough. The cap also has a neck portion having an inner and an outer surface connecting to the vent portion. The neck portion extends away from the valve body and the inner and outer surface are generally parallel to each other for a first length. The outer surface of the neck then tapers towards the inner surface for a second length. A rim portion of the cap has a first wall and a second wall, wherein the first and second wall are connected at the upper ends, forming a channel between the first and second walls. One of the first and second walls can be connected to the outer periphery of the vent portion.

As another aspect of the invention, the lower portion of the cap has a first segment with a thickness substantially equal to the first width of the annular recess and a second segment, and at least a portion of the second segment can have a thickness substantially equal to the second width of the channel in the annular recess. The valve body may be made of an elastomeric material and the cap may be made of a rigid material such that the first and second walls of the annular recess expand apart to permit the second segment of the cap to pass through to the channel.

As another aspect of the invention, the cap further includes a first set of tabs disposed around the inner surface of the neck portion. A first set of tabs are preferably disposed within the neck and around the lower end of the inner wall of the neck, extending radially into the neck to engage the slit portion of the valve body. The cap can further include a second set of tabs. The second set of tabs are disposed around the lower end of at least one of the first and second walls of the rim portion, extending into the channel of the rim portion to engage the container.

As another aspect of the invention, the valve assembly can include a dip tube. The outer diameter of the dip tube is substantially equal to the diameter of the inner periphery of the valve body. The dip tube is inserted into the inner periphery of the valve body and extends downward into the container. Preferably, a seat is formed around the inner periphery of the valve body such that the dip tube is inserted into the inner periphery until it engages the seat.

These and other aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
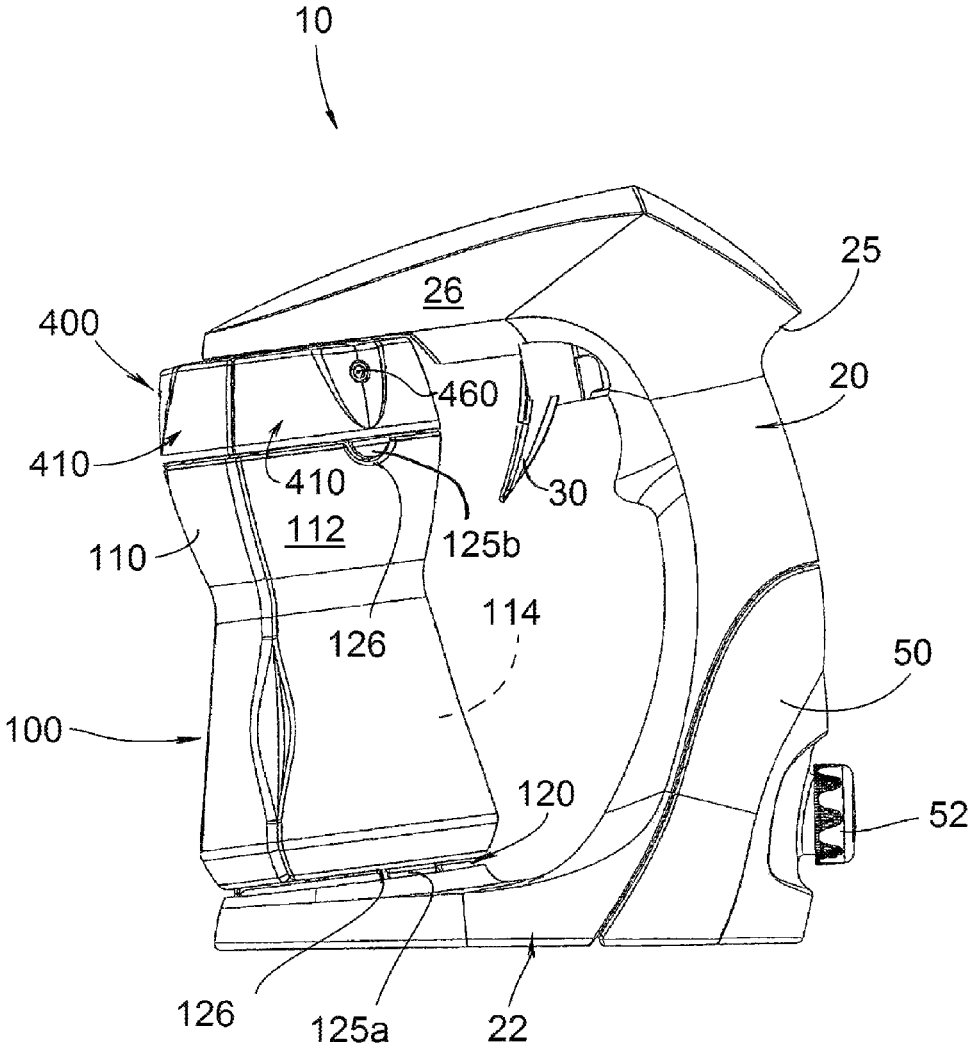
FIG. 1 is a perspective view of a first embodiment of a dispensing device of the present invention.

In describing the preferred embodiments of the invention which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words connected, attached, or terms similar thereto are often used. However, they are not limited to direct connection but include connection through other elements where such connection is recognized as being equivalent by those skilled in the art.

DETAILED DESCRIPTION OF THE INVENTION

The present invention and the various features and advantageous details thereof are explained more fully with reference to the non-limiting embodiments described in detail in the following description.

I. System Overview

In a basic form, referring generally to FIGS. 1-11, the invention is a fluid dispensing device, preferably, a hand-held device, e.g., dispensing device 10, that holds a diluent "D" and at least one concentrated substance or concentrate "C" separate from each other. The diluent "D" and concentrate "C," remain separate until they are actively dispensed and mix with each other momentarily while exiting the device, whereby an end use product exits the dispensing device 10.

The diluent "D" can be a liquid diluent and/or other suitable fluid carrier, preferably, a solvent and, more preferably, water. The concentrate "C" can be a concentrated liquid chemical composition, or a gaseous, powdered, or other relatively concentrated substance. The dispensed end use products, made from actively mixing the diluent "D" and concentrate "C" during dispensation, can be any of a variety of compositions, agents, and/or solutions, preferably, one or more of numerous cleaning solutions or chemicals.

Exemplary of such end use products include, but are not limited to: general purpose cleaners, kitchen cleaners, bathroom cleaners, dust inhibitors or removal aids, floor and furniture cleaners and polishes, glass cleaners, anti-bacterial cleaners, fragrances, deodorizers, soft surface treatments, fabric protectors, laundry products and/or other fabric cleaners or stain removers, tire cleaners, dashboard cleaners, automotive interior cleaners, and/or other automotive industry cleaners or polishes, or even insecticides. In some embodiments, a single device 10 dispenses multiple end use products that use a common fluid carrier or diluent "D." Accordingly, the particular components, compositions, constituents, and respective concentrations of the diluent "D" and one or more concentrates "C" are selected based on the particular desired end use product that will be actively mixed while exiting the dispensing device 10.

In such configuration, the dispensing device 10 is designed to allow a user to quickly replace or replenish the diluent "D" or ones of the one or more concentrate "C" as needed or desired. In some implementations, e.g., the user can select from multiple end use products to dispense from a single hand-held dispensing device 10 those which incorporate multiple, different concentrates "C". This provides convenient access to different products and, for example, easier cleaning of multiple surfaces that require a different cleaning product be used on each of them.

The dispensing device 10 and its components and subassemblies are preferably made from generally lightweight and durable materials. Exemplary of suitable materials are lightweight polymeric materials or various polymeric compounds, such as, for example, and without limitation, various of the polyolefins, such as a variety of the polyethylenes, e.g., high density polyethylene, or polypropylenes. There can also be mentioned as examples such polymers as polyvinyl chloride and chlorinated polyvinyl chloride copolymers, various of the polyamides, polycarbonates, and others.

For any polymeric material employed in structures of the invention, any conventional additive package can be included such as, for example, and without limitation, slip agents, anti-block agents, release agents, anti-oxidants, fillers, and plasticizers to control, e.g., processing of the polymeric material as well as to stabilize and/or otherwise control the properties of the finished processed product, also to control hardness, bending resistance, and the like. Common industry methods of forming such polymeric compounds will suffice to form the polymeric components of dispensing device 10. Exemplary, but not limiting, of such processes are the various commonly-known plastic converting, molding, and/or other processes.

1. Dispensation Generally

Referring still to FIGS. 1-11, the dispensing device 10 is manually activated, preferably by a manual pump-type, electrical pump-type, aerosol, pressurized, and/or other delivery system to dispense an end use product, preferably, a cleaning solution. During the act of dispensation, a diluent "D" and a concentrate "C" are combined and mixed with each other, e.g., at least partially prior to exiting the device so that they emerge as a final, combined, ready-to-use solution or end use product, preferably, a cleaning solution or cleaning chemical composition.

In this regard, the acts of dispensing and mixing or combining the diluent "D" and concentrate "C" are not mutually exclusive. Rather, discrete mixing acts of the diluent "D" and concentrate "C" are performed in concert with discrete dispensation acts. Correspondingly, a volume of end use product need not be stored in the device, since the dispensation effectuates suitable mixing of the diluent "D" and concentrate "C" in creating the resultant end use product.

It is noted that the particular dispensation techniques and methods are selected based, at least in part, on the intended end use of dispensing device 10. In other words, dispensing device 10 is adapted for dispensation by way of, e.g., manual pump-type, electrical pump-type, aerosol, pressurized, or other delivery systems in view of considerations such as viscosity, flow, density, and/or other characteristics of the diluent "D," concentrate "C," or end use product(s), as well as the end use environment or other operational considerations.

Regardless of the particular dispensing technique or method used, the dispensing device 10 can be configured to operate by pumping or otherwise expelling the diluent "D" so that the diluent "D," as it flows through the dispensing device 10, draws the concentrate "C" into its flow path by way of e.g., pressure differentials according to Bernoulli's principles, explained in greater detail elsewhere herein. In this configuration, only the diluent "D" needs to be acted upon in order to suitably mix and dispense both the diluent "D" and concentrate "C" as an end use product.

1a. Manual Pump Dispensation

Referring now to FIGS. 1-9, some embodiments the dispensing device 10 function based primarily on principles associated with manually actuated, trigger-type spray bottles. In such embodiments, the dispensing device 10 includes a trigger 30 that actuates a piston within or otherwise operates a manual pump assembly 35. Any of a variety of known types, styles, or configurations of manual pumps and/or their respective components, e.g., pitons, dip tubes, check valves, valve seats, compression or return springs, and others are suitable for use as manual pump assembly 35, some or all of which are well known to those skilled in the art.

1b. Non-Manual Pump Dispensation

Figure 10:
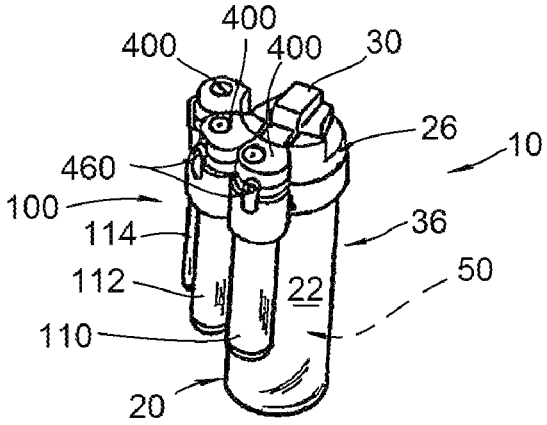
FIG. 10 is a perspective view of a seventh embodiment of a dispensing device of the present invention.
Figure 11:
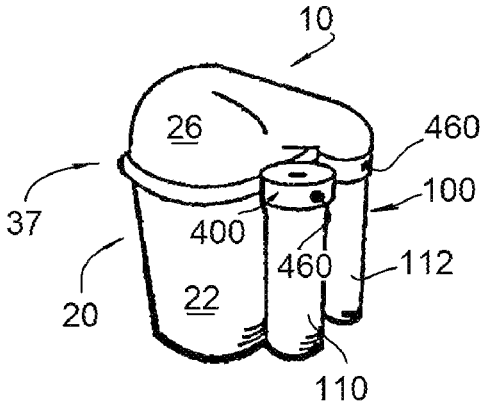
FIG. 11 is a perspective view of an embodiment of a dispensing device of the present invention.

Referring now to FIGS. 10-11, some embodiments of dispensing device 10 do not use manually actuated or trigger-style pumps, but rather use other forces to expel contents from the dispensing device 10. For example, the dispensing device 10 seen in FIG. 10 utilizes aerosol dispensation by way of an aerosol system 36. Any of a variety of known types, styles, or configurations of aerosol systems and/or their respective components, e.g., a propellant such as pressurized gas or liquefied gas or others, dip tubes, check valves, valve seats, compression or return springs, and others are suitable for use as aerosol system 36, all of which are well known to those skilled in the art. As another example, the dispensing device 10 seen in FIG. 11, utilizes pressurized dispensation by way of a pressurized system 37. Here again, any of a variety of known types, styles, or configurations of stored positive pressure-based systems and/or their respective components, e.g., CO2 and/or other pressure vessels, dip tubes, check valves, valve seats, compression or return springs, electronic (i) pumps, (ii) switches or triggers, (iii) power supplies (iv) corresponding conductors and other circuit components, and/or others are suitable for use as pressurized system 37, all of which are well known to those skilled in the art.

II. Detailed Description of Preferred Embodiments

Specific embodiments of the present invention will now be further described by the following, non-limiting examples which will serve to illustrate various features of significance. The examples are intended merely to facilitate an understanding of ways in which the present invention may be practiced and to further enable those of skill in the art to practice the present invention. Accordingly, the examples discussed herein should not be construed as limiting the scope of the present invention.

Referring now to FIGS. 1-11, dispensing device 10 includes a housing 20 that holds a reservoir 50 and a container assembly 100 that has and/or is connected to an outlet assembly 400. The reservoir 50, container assembly 100, and outlet assembly 400 cooperate with each other for mixing and dispensing the diluent "D" and concentrate "C," which are stored in the reservoir 50 and container assembly 100, respectively, as an end use product. It is noted that by maintaining the diluent "D" and concentrate "C" as distinct stored entities, the user can refill or replace the diluent "D" independently from the concentrate "C" and vice versa.

Referring specifically to the manually actuated, trigger-type spray embodiments of FIGS. 1-9, each housing 20 includes a main body segment 22 at a lower portion thereof, and a handle 24 that extends generally upwardly from the main body segment 22. Handle 24 is configured to provide a suitably comfortable gripping structure enabling a user to hold and manipulate the dispensing device 10 for durations of time commensurate with the time required to dispense the end use product and/or carry the dispensing device 10 to different surfaces or rooms to be cleaned or treated. In some implementations, such as those seen in FIGS. 1, 2, and 4, the handle 24 can include a projection 25 which rests upon, e.g., an intersection of a thumb and forefinger of a user, enhancing the user's comfort and holding stability, especially during prolonged periods of use.

Referring still to FIGS. 1-9, head 26 extends outwardly from an upper portion of handle 24, in the same general direction as the main body segment 22. In this configuration, head 26 can extend at least partially over the main body segment 22 of housing 20. Preferably, various ones of, optionally all of, main body segment 22, handle 24, and head 26 are hollow, whereby the housing 20 defines a shell-like outer perimeter wall(s), encapsulating a void "V" (FIG. 12) therein which is configured to house various other components of the dispensing device 10 therein.

Figure 12:
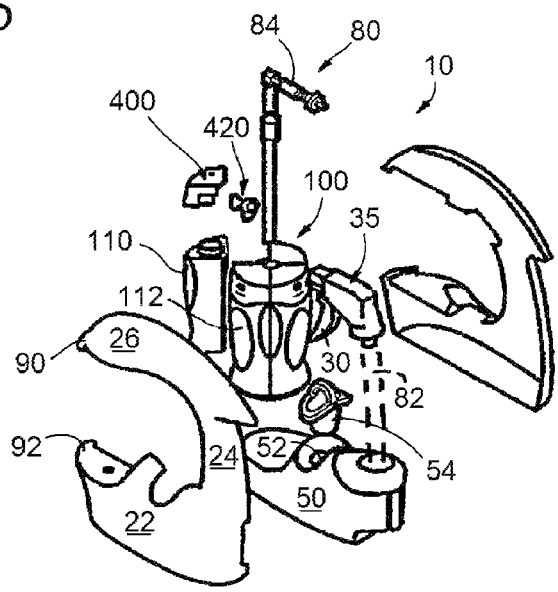
FIG. 12 is an exploded, perspective view of the device of FIG. 4.

As desired, in some embodiments, the various components of the housing 20 are removably attached to each other, by way of friction fit, snap-lock, or otherwise. For example, (i) an assemblage of handle 24 and head 26 can be selectively removed from main body segment 22, (ii) head 26 can be selectively removed from an assemblage of main body segment 22 and handle 24, or (iii) each of the main body segment 22, handle 24, and head 26 can be selectively removed from respective ones of each other. The particular removable attachment(s) of the various components within the housing 20 to each other is directed at least on part by, e.g., how diluent is "D" is stored, housed, filled, or refilled, within a particular implementation of dispensing device 10. In some embodiments, a sight window (now shown) is provided upon the housing 20 and configured for enabling a user to easily, at a glance, evaluate the volume of carrier fluid within the reservoir 50 at any particular time. As best seen in FIG. 12, reservoir 50 is housed within the void "V" of housing 20, is configured to hold a volume of diluent "D" therein, and is, preferably, made from a lightweight rigid polymeric material. In this configuration, the reservoir 50 functions as a standalone liquid tight enclosure, whereby any of a variety of suitable bottles, cans, and/or other enclosures may be implemented as reservoir 50.

Referring now to FIG. 12, in this embodiment, the reservoir 50 includes an inlet 52 and a removable plug 54, while other embodiments include, for example, a threaded cap instead. The inlet 52 extends through the outer wall of housing 20 opening and into the reservoir 50. For example, inlet 52 can extend through an upper wall of main body segment 22, entering reservoir 50, but can be located elsewhere such as, e.g., upon handle 24 or head 26 (FIG. 6), as long as the inlet 52 is fluidly connected to the reservoir 50. In the embodiment shown in FIG. 12, the inlet 52 enters reservoir 50 through the upper wall of main body segment 22, the dispensing device 10 is preferably configured for filling or refilling with a volume of water diluent "D." For embodiments that use water as diluent "D," the water may be filtered water, distilled water, deionized water, or may be tap water from, e.g., conventional bathroom sink basins, corresponding faucet fixtures, or other water delivering fixtures. In this particular embodiment, the height dimensions of the reservoir 50 and the corresponding portions of main body segment 22 of housing 20 are sufficiently small in magnitude or short enough to allow the user to slide the inlet 52 between a conventional sink basin and faucet, aligning the inlet 52 of reservoir 50 with an outlet of the faucet. Furthermore, there is preferably adequate clearance between the trigger 30 inlet 52, as well as other portions adjacent the inlet 52, so that the user need not actuate the trigger 30 while aligning inlet 52 with the faucet, or otherwise struggle during such diluent "D" refill alignment step.

Referring now to FIG. 1, the reservoir 50 of this embodiment is housed substantially or entirely in the handle 24 instead of the main body segment 22. Accordingly, a height dimension of main body segment 22 in this embodiment is a mere fraction of an overall height of the device, for example, less than about 20 percent or less than about 15 percent of the overall device height. In this configuration, none of the diluent "D" is housed directly below the container assembly 100, whereby the portion of the device weight that is attributable to weights of the diluent "D" and concentrate "C" are longitudinally spaced from each other, along the device's centerline. In this embodiment the housing 20 extends only partially over the reservoir 50, leaving at least portions of a back wall as side walls of the reservoir 50 exposed. Inlet 52 is provided on an exposed portion of the reservoir 50, at the back and near the bottom of the device. For example, inlet 52 can be positioned within two inches from a bottom wall of the device, optionally within one inch from the bottom wall.

The particular material(s) and configuration of reservoir 50 are selected based on the particular end use environment, the particular fluid or diluent "D" to be dispensed, and the type of delivery system used. For example, in lieu of a rigid polymeric reservoir 50 such as that seen in FIG. 12, as desired, reservoir 50 can instead be a flexible polymeric bag-type enclosure structure (not illustrated). The flexible polymeric bag embodiment of reservoir 50 can be adapted and configured for single use with subsequent disposal. Such implementations can be particularly desirable for implementations of dispensing device 10 that use diluents "D" which the user does not want to potentially touch, e.g., if the diluent "D" is or includes any of a variety of acidic, basic, caustic, or irritating substances. Notwithstanding, as desired, the flexible polymeric bag embodiment of reservoir 50 can be refillable and adapted and configured for multiple uses.

Referring again to FIG. 12, a tubing assembly 80 is housed within the housing 20 and is configured for directing diluent "D" between reservoir 50 and container assembly 100. Tubing assembly 80 includes a pump inlet tubing 82 and a pump outlet tubing 84. Pump inlet tubing 82 spans between and connects the manual pump assembly 35 to the reservoir 50, and pump outlet tubing 84 spans between and connects the pump assembly 35 to the container assembly 100. In other words, the pump assembly 35 (i) draws diluent "D" from reservoir 50 through the pump inlet tubing 82 and pushes it to container assembly 100 through pump outlet tubing 84. In some embodiments, such as that illustrated in FIG. 12, part of the pump outlet tubing 84 is an elongate member 85 that extends downwardly, axially at least partially into the container assembly 100. In such embodiments, an outlet bore 86 extends radially, horizontally, or otherwise through the sidewall of the pump outlet tubing 84, adjacent its bottom end that interfaces the container assembly 100. The outlet bore 86 (FIG. 14) can be fluidly and operably connected to a portion of container assembly 100, for directing the diluent "D" therethrough while using dispensing device 10.

Referring still to FIG. 12, in some embodiments, upper and lower retaining flanges 90, 92 are provided on housing 20 for, e.g., holding and aligning container assembly 100 during use. Upper and lower retaining flanges 90, 92 extend angularly forward from the front edges of the respective ends of the housing 20 that hold the container assembly 100. As desired, the upper and lower retaining flanges 90, 92 can have generally the same radius as the outer perimeter of housing 20, whereby they appear to be tabular extensions of the housing 20 outer wall. Optionally, the upper and lower flanges 90, 92 have other shapes and/or radii. In the embodiment shown in FIG. 12, the inwardly facing surfaces of flanges 90, 92 directly interface the outwardly facing surfaces of the container assembly 100. The retaining flanges 90, 92 therefore mechanically urge the container assembly 100 rearward toward the remainder of the housing 20. This can help mitigate the likelihood of non-desired rotation, misalignment, or other movement of the container assembly 100 within the housing 20.

Referring again to FIG. 1, in this embodiment, the container assembly 100 is tilted at a slight forward angle, for example, less than about 15 degrees or less than about 10 degrees when viewed from a side elevation, so that an upper portion of the container assembly 100 leans in front of a lower portion of the container assembly 100. The particular angle of inclination of the container assembly 100 is preferably selected based at least in part on the configuration of the one or more containers of the container assembly 100. The axis of rotation of the container assembly 100 of this embodiment is tilted forward to an extent that allows relatively small volumes of concentrate "C," for example, a volume that is less than about ⅛ of the total holding capacity of the container, to pool or collect in a front lower corner of the container. Since a dip tube 390 extends into the front lower corner of a container of the container assembly 100 that is in a forward-facing position, described in greater detail elsewhere herein, such configuration allows substantially the entire contents of concentrate "C" to be drawn from the container assembly 100 during use without have to shake or tilt the device 10 or otherwise hold it at an awkward angle while trying to fully deplete a container of concentrate "C".

Figure 13:
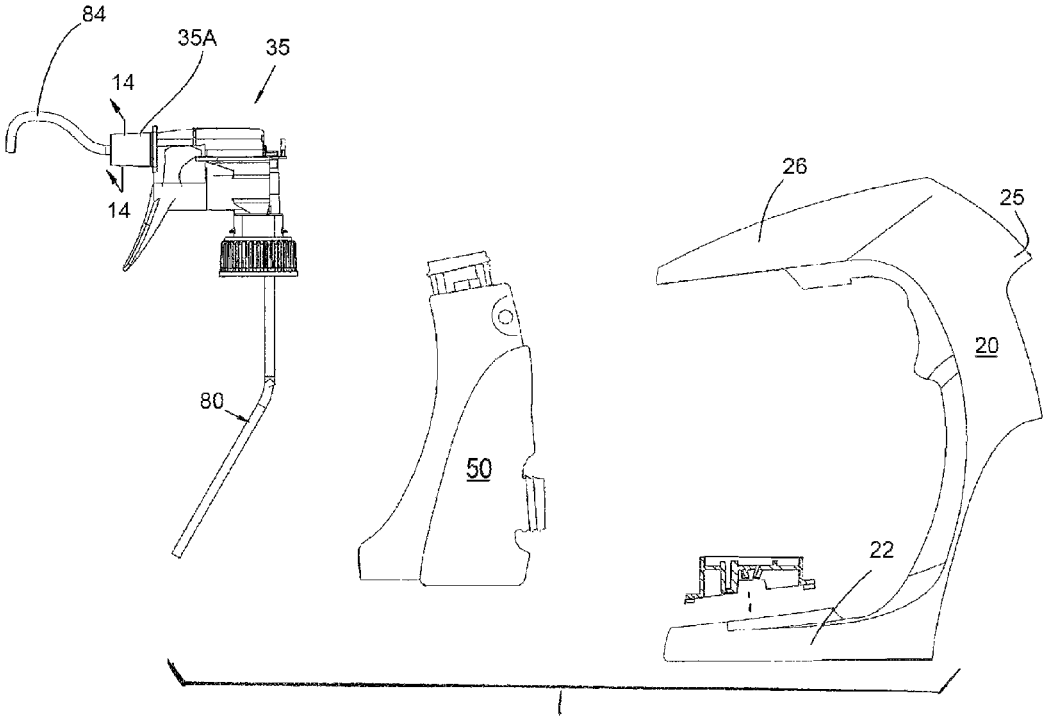
FIG. 13 is an exploded, side elevation view of the reservoir and pump assembly of the dispensing device of FIG. 1.
Figure 14:
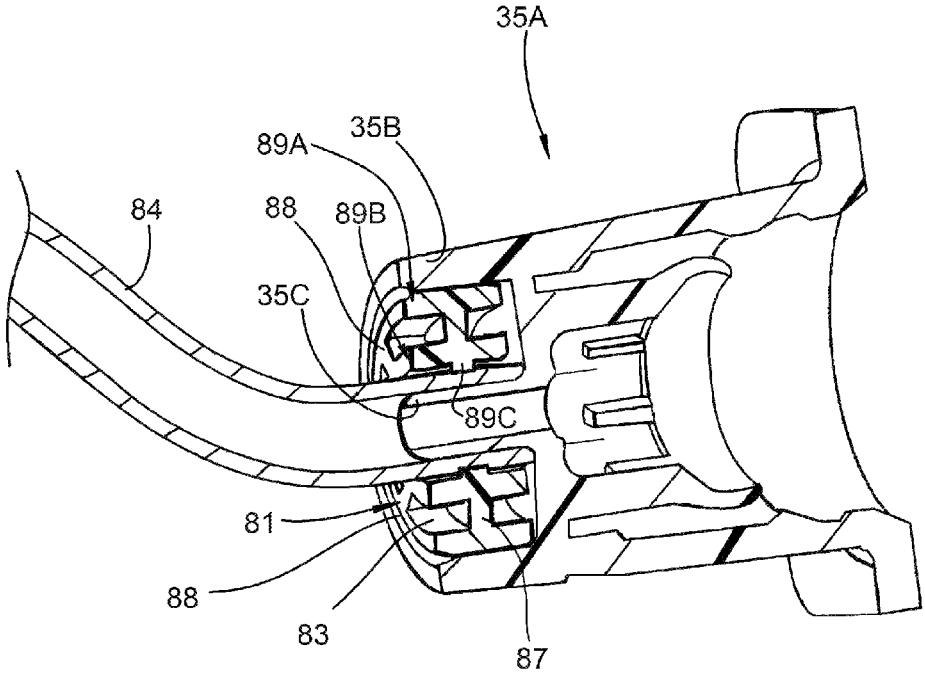
FIG. 14 is a pictorial cross-sectional view of the tube retainer of the pump assembly of FIG. 13, taken generally at line 14-14 of FIG. 13.

Referring now to FIGS. 1, 13 and 14, a variation of the tubing assembly 80 of FIG. 12 is shown for directing diluent "D" between reservoir 50 and container assembly 100. In this embodiment, the tubing assembly 80 includes a tube retainer 81 that clamps the end of the pump outlet tubing 84 to a nozzle 35A of the manual pump assembly 35A. Seen best in FIG. 14, an end of the nozzle 35A has an outer collar 35B that is concentrically spaced around a cylindrical outlet 35C and the tube retainer 81 has an annular configuration. Pockets 83 that are spaced from each other extend along arcuate paths and in an axial direction from opposing sides of the tube retainer 81, toward a web 87 of material that extends radially through the middle of the tube retainer 81. In such configuration, spokes 88 that space the adjacent pockets 83 from each other also connect outer and inner rings 89A, 89B of the tube retainer that are defined at its outer an inner perimeters. A ledge 89C extends inwardly from the inner circumferential surface of the inner ring 89A and provides a mechanical gripping surface that enhances the holding force that the tube retainer 81 applies to the pump outlet tubing 84 by way of its radial inward compression caused by an interference fit between the tube retainer 81 and the outer collar 35B of the nozzle 35A.

Regardless of the particular configuration of the tube retainer 81, it is configured to provide a retention force to the pump outlet tubing 84 so as to prevent the pump outlet tubing 84 from sliding off the cylindrical outlet 35C of the nozzle 35A during use. The tube retainer 81 of this embodiment is configured to provide a retention force to the pump outlet tubing 84 that holds it in place while enduring operating pressures of at least about 60 psi and preferably at least about 90 psi during use or at least during discrete dispensing acts in which the trigger of device 10 is being actuated.

Referring again to FIGS. 1-11, each container assembly 100 is configured to hold at least one concentrate "C" therein, to be mixed with the diluent "D" and each container assembly 100 is preferably a disposable use item although it can be adapted and configured for refillable use in which case the container assembly 100 may include a cap or other removable or accessible structure allowing the container to be refilled.

Figure 2:
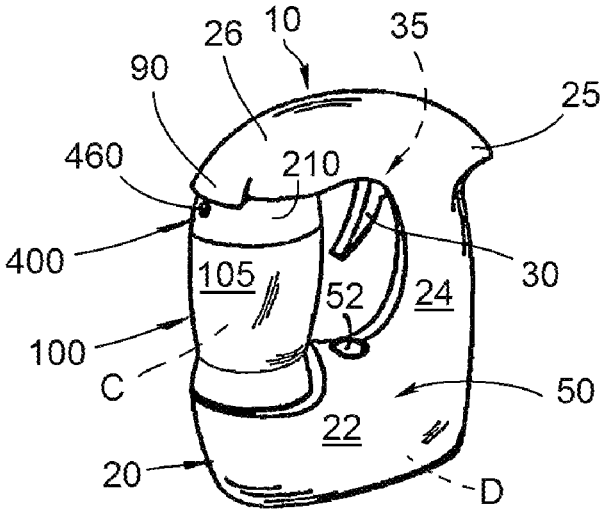
FIG. 2 is a perspective view of a variant of the dispensing device of FIG. 1.
Figure 3:
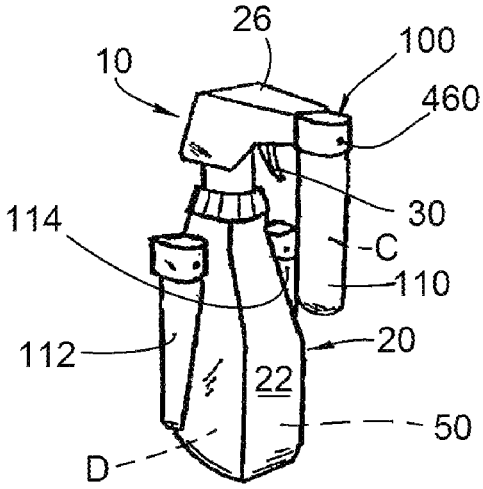
FIG. 3 is a perspective view of a second embodiment of the present invention.
Figure 4:
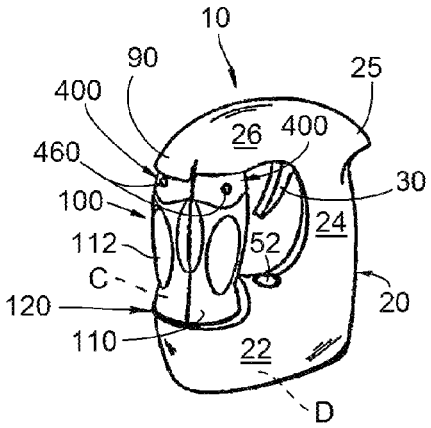
FIG. 4 is a perspective view of a variant of the dispensing device of FIG. 2.
Figure 5:
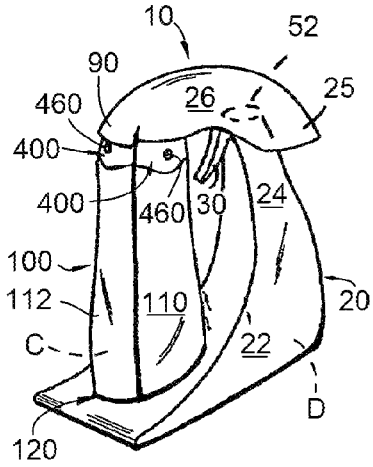
FIG. 5 is another variant of the dispensing device of FIG. 1.
Figure 6:
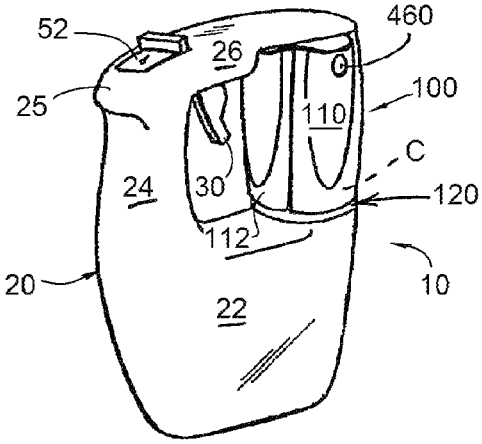
FIG. 6 is a perspective view of a third embodiment of a dispensing device of the present invention.
Figure 7:
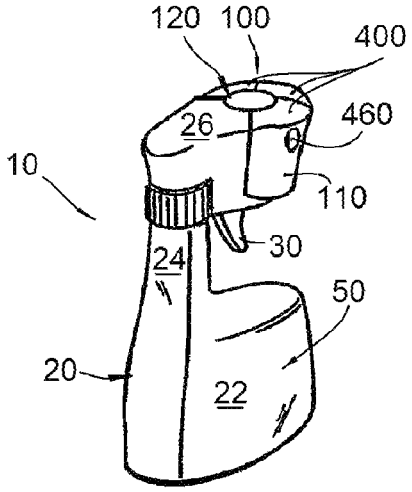
FIG. 7 is a perspective view of a fourth embodiment of a dispensing device of the present invention.

Since each container assembly 100 includes at least one container body 105 (FIG. 2), 110, 112, 114, 116, (FIGS. 1 and 3-11) for holding or storing the concentrate "C," the number of end use products that can be dispensed through dispensing device 10 corresponds to the number of different container bodies 105, 110, 112, 114, 116, (FIGS. 1 and 3-11) and thus concentrates "C" that are incorporated into the particular container assembly 100. As shown in FIG. 2, this embodiment utilizes a single container body 105 that is able to hold relatively more of a single concentrate than would multiple container bodies 110, 112, 114, 116 that were configured to cumulatively occupy the same space within the device 10. Holding a relatively greater volume of concentrate "C" may be desirable when a user anticipates using a relatively large volume of a single end use product, for example, when cleaning opposing surfaces of numerous windows, the user can implement a container assembly 100 with a single container body 105 which holds a concentrated glass cleaner as the concentrate "C". In still another embodiment of the present invention (not illustrated), a single container body 105 is provided, similar to that illustrated in FIG. 2, only having multiple compartments, chambers, dividers, pockets, or any other means of separating a single void into multiple distinct liquid tight segments for housing individual concentrates "C".

Referring now to FIGS. 1, 4-8, and 15-16, these multiple container body versions preferably include a rotating frame 120 that is a carousel-type mechanism configured to rotate about an axis of rotation for selectively indexing one of the container bodies 110, 112, 114, 116 into a use position in which that particular selected container body 110, 112, 114, 116 is aligned for dispensing its contents while the remaining container bodies 110, 112, 114, 116 are in non-use or non-dispensing positions, explained in greater detail elsewhere herein.

Referring again to FIGS. 1-11, the container assemblies 100 can be generally modular enclosures which enable their removal, attachment, and interchangeability with the remainder of dispensing device 10. In such configuration, the various embodiments of container assemblies 100 are interchangeable with each other, whereby users can determine the number of end use products to be readily available by utilizing the dispensing device 10 at any given time. In other words, as desired, the user can implement (i) a container assembly 100 that houses multiple concentrates "C" in multiple container bodies 110, 112, 114, 116 (FIGS. 10-15), or (ii) a container assembly 100 that houses a single concentrate "C" in a single container body 105 (FIG. 1), for either multiple or single end product capability, respectively. Stated another way, device 10 can be reconfigured for single or multiple product dispensation by interchanging a single container body 105 with a rotating frame 120 and its associated container bodies 110, 112, 114, 116, or vise versa.

The size and shape of the container body 105, 110, 112, 114, 116, may vary depending on the particular embodiment of the device 10 as well as, in some embodiments, based on the particular mix ratio of the end product which is dispensed from the device 10. For example, devices 10 that dispense end products that have relatively higher mix ratios of concentrate "C" to diluent "D" may include container bodies 105, 110, 112, 114, 116 with relatively greater volumes or hold more as compared to container bodies 105, 110, 112, 114, 116 of devices 10 that dispense end products that have relatively lower mix ratios of concentrate "C" to diluent "D". Several embodiments of the container body, as illustrated in FIGS. 1-11, include but are not limited to, a tubular, wedge, rectangular, or generally cylindrical shaped containers. In general, in container assemblies 100 that utilize multiple container bodies 110, 112, 114, 116, each container body 110, 112, 114, 116 typically includes top and bottom walls, a front wall that faces outwardly from the container assembly 100, a back wall the faces into the container assembly 100 and opposing sidewalls that taper from the front wall to the back wall or converge with each other in embodiments that do not include a distinct back wall. Such configurations allow the multiple container bodies 110, 112, 114, 116 to nest into the rotating frame 120 in an orderly way while cumulatively presenting an aesthetically acceptable overall shape while providing a holding capacity that allows each container body 110, 112, 114, 116 to hold a suitable amount of concentrate "C" so that it has an acceptably long use life.

Figure 18:
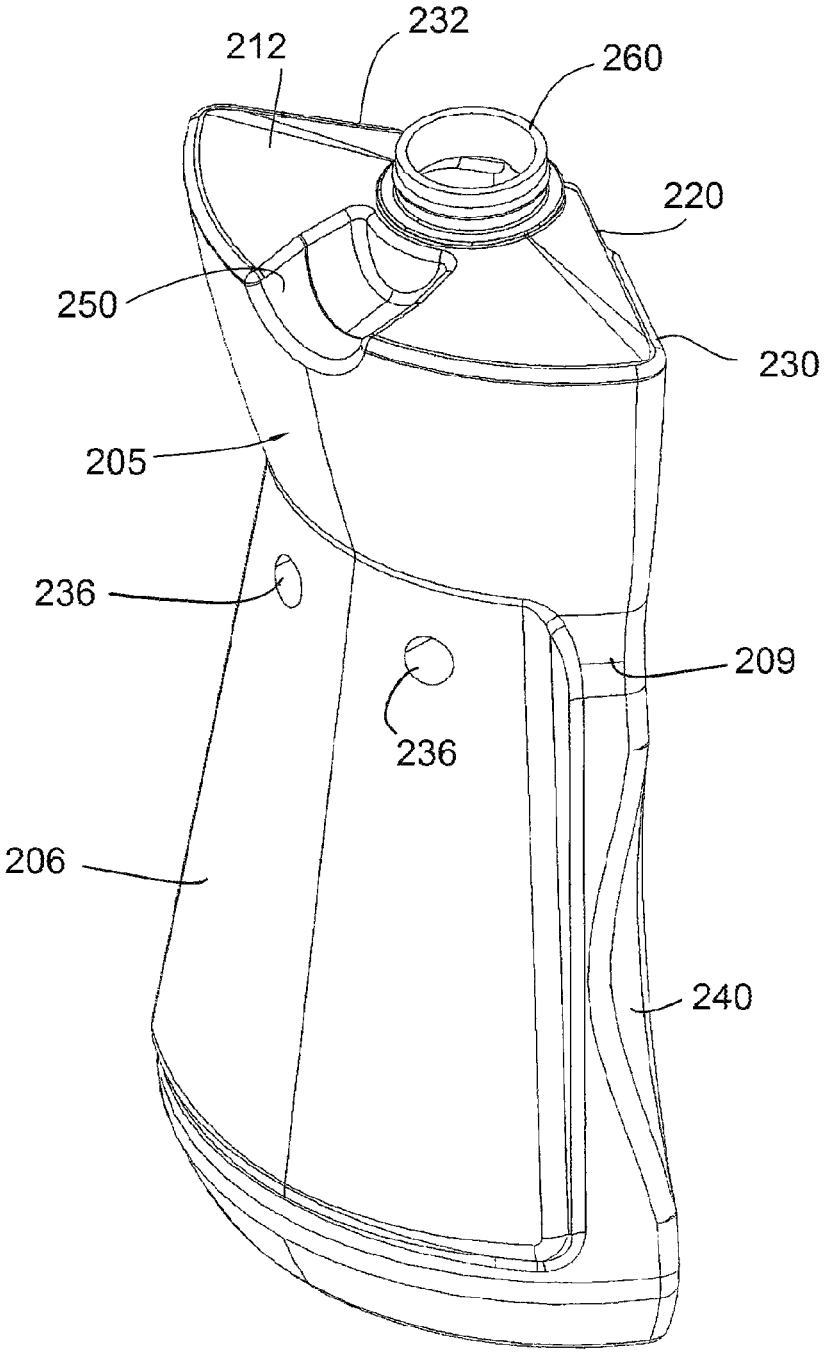
FIG. 18 is an isometric view of a variant of the container body of FIG. 17.
Figure 19:
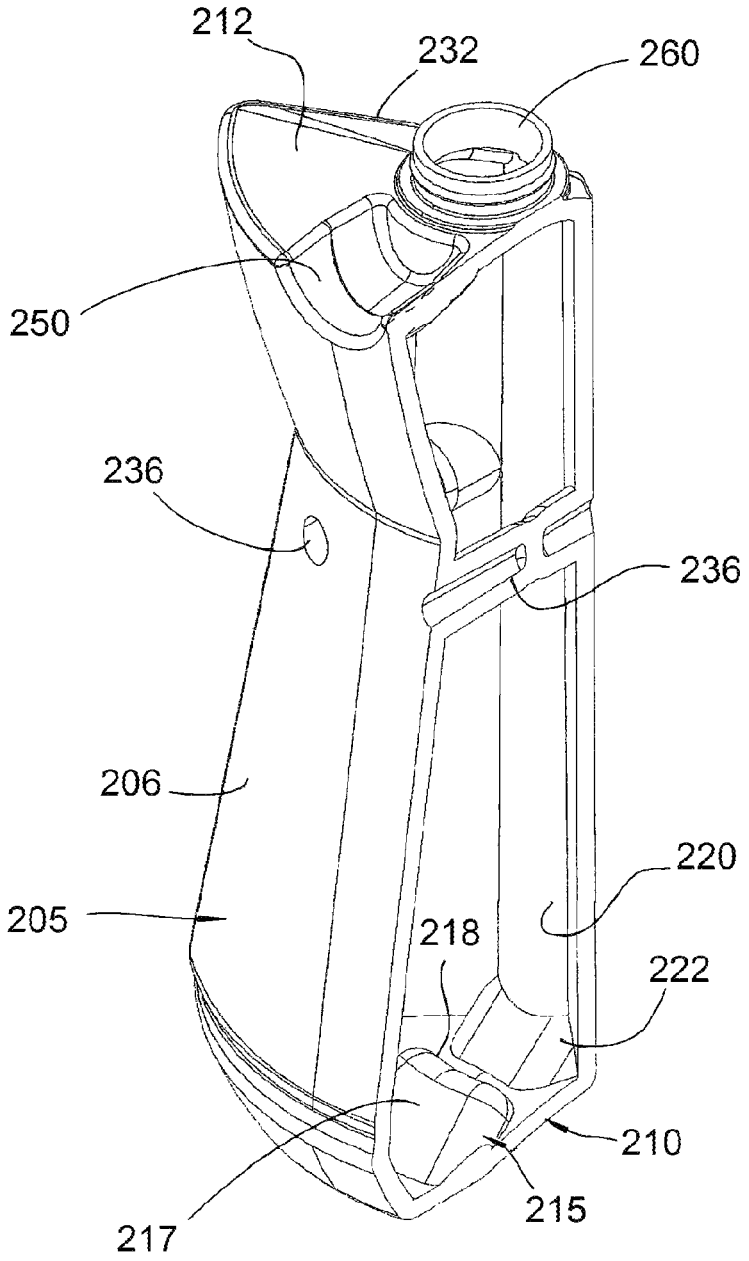
FIG. 19 is an isometric cross-sectional view of the container body of FIG. 18 taken through an inner support of the container body.
Figure 20:
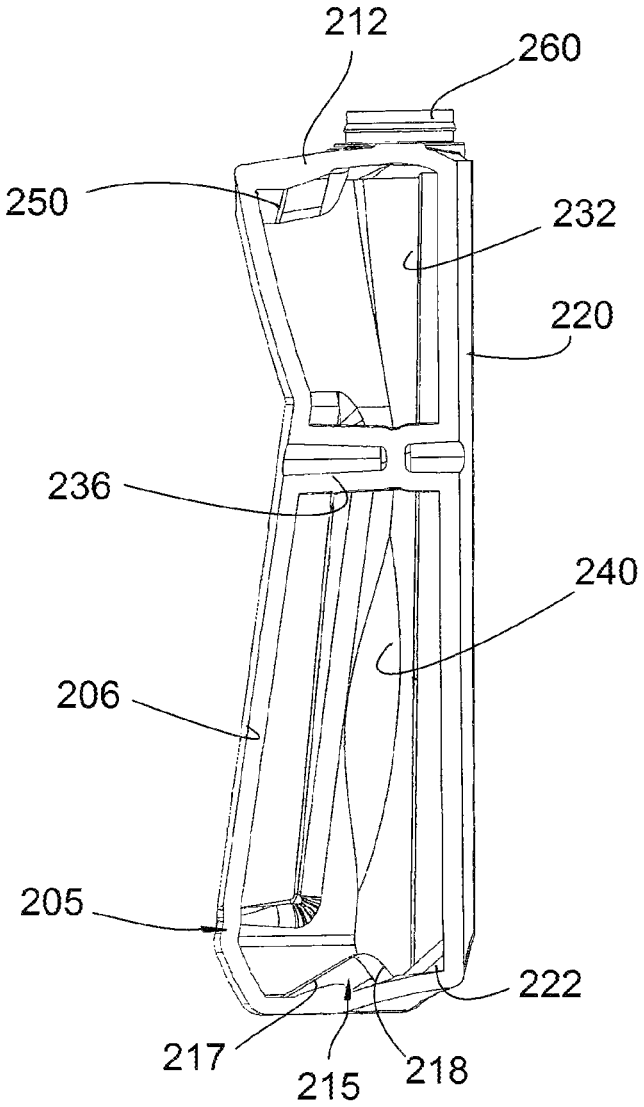
FIG. 20 is a side elevation cross-sectional view of the container body of FIG. 18 taken through an inner support of the container body.

For example, referring now to FIGS. 17-20 and shown with respect to container body 110 while also being applicable to the other container bodies, this embodiment includes a front wall 205 that faces outwardly from the container assembly 100 and a back wall 207 that faces into the container assembly 100. The front wall 205 is wider toward its top and bottom, having bottom and top portions that taper inwardly toward a relatively narrower waist segment 209 defined therebetween. As shown in FIGS. 18-20, in this embodiment, the front wall 205 further includes a raised panel 206 that is configured for having a label attached to it and is relatively flatter than the remainder of the front wall 205. Panel 206 of this embodiment extends up the bottom portion 207, upwardly across the waist segment 209, and onto the top portion 208.

Still referring to FIGS. 17-20, lower and upper walls 210 and 212 extend in a rearward direction from the bottom and top portions of the front wall 205, respectively, and toward the back wall 207. Both the lower and upper walls 210 and 212 are configured to interlock with the rotating frame 120. A lower locking receptacle 215 extends upwardly into wall 210 and is spaced from rearward of the front wall 205, the receptacle 215 being wider toward the front wall 205 and tapering to a narrower width as it extends away from the front wall 205. Lower locking receptacle 215 includes first and second ramped segments 217, 218 that extend angularly up from the lower wall 210 and intersect each other at an apex, defining a generally inverted V-shaped profile. The second ramped segment 218 which is positioned further rearward of the front wall 205 is provided at a steeper angle with respect to the lower wall 210 when compared to the first ramped segment 217.

Shown best in FIGS. 19-20, a channel 222 extends angularly between a back wall 220 of the container body 110 and the lower wall 210, connecting the lower and back walls 210 and 220 to each other. In this embodiment, the channel 222 is aligned with the lower locking receptacle 215 and it connects to the second ramped segment 218 of the receptacle 215 so that the channel 222 serves as a lead-in guide through which a flexible tab 125*a* (FIG. 16) of the rotating frame 120 slides when the container body 110 is being inserted into the rotating frame 120, explained in greater detail elsewhere herein. Preferably, the point of attachment of the channel 222 and lower locking receptacle 215 is positioned higher than the lower wall 210 so that the channel 222 and receptacle 215 together define a progressively stepped ramp to progressively deflect the tab 125*a* during insertion of the container body 110 into the rotating frame 120.

Referring again to FIGS. 17-20, side walls 230, 232 of the container body 110 extend from outer lateral edges of the front wall 205, rearward toward and connecting to the back wall 207. Preferably, thumb grips or thumb depressions 240 extend into the side walls 230, 232 with each thumb depression 240 spanning between the respective side wall 230, 232 and the front wall 205.

Referring again to FIGS. 18-20, this embodiment includes an inner support that is shown as including a pair of posts 236 that extend generally orthogonally between the front and back walls 205 and 207 of the container body 110 and are configured to maintains the front and back walls 205 and 207 a generally constant distance from each other, reducing a likelihood of the container body 110 bulging out or collapsing in. The posts 236 sits on opposite sides of a centerline of the container body 110 are spaced inwardly from the side walls 230, 232. The posts 236 are provided at a height that is slightly below the waist segment 209 of the container body 110. In some embodiments, each post 236 is a single, unitary, structure. In other embodiments, each of the posts 236 can include a hollow cylindrical front segment that extends through the front wall 205 toward the back wall 207 and a hollow cylindrical back segment that extends from the back wall 207 wall toward the front wall 205. The front and back segments of such posts 236 can be distinct from each other when initially molded or otherwise formed and then in some embodiments joined to each other, for example, at their facing ends by mechanically squeezing the ends together, optionally by way of bonding, adhesion, welding, and/or other suitable forms of joinder.

Referring once again to FIGS. 17-20, an upper locking receptacle 250 extends into the upper wall 212 of the container body 110. The upper locking receptacle 250 of this embodiment extends through the front wall 205 and defines a semi-circular perimeter shape, when the container body 110 is viewed from a front elevation. A collar 260 extends upwardly the upper wall 212, rearward of the upper locking receptacle 250. An opening that extends through the collar 260 provides access to the contents of the container body 110 and allows the inside of the container body 110 to be vented.

Figure 21:
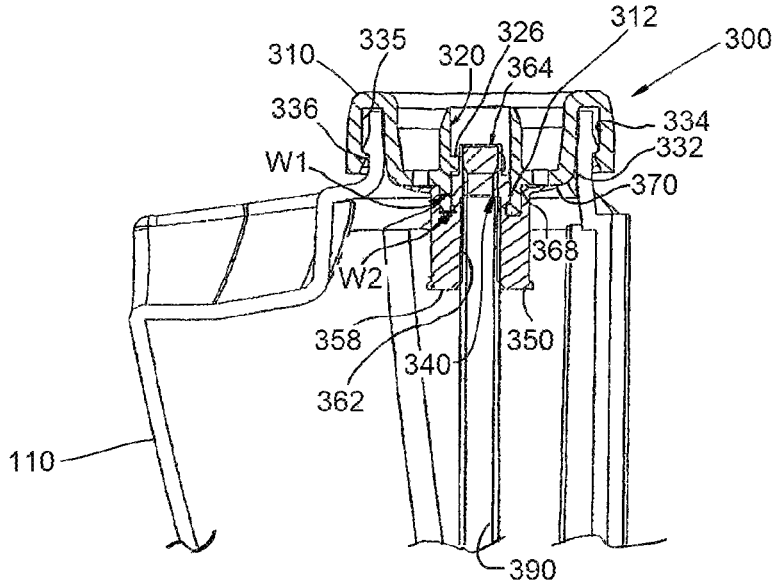
FIG. 21 is a cross-sectional view of the top of the container body of FIG. 17 taken generally at line 21-21.
Figure 22:
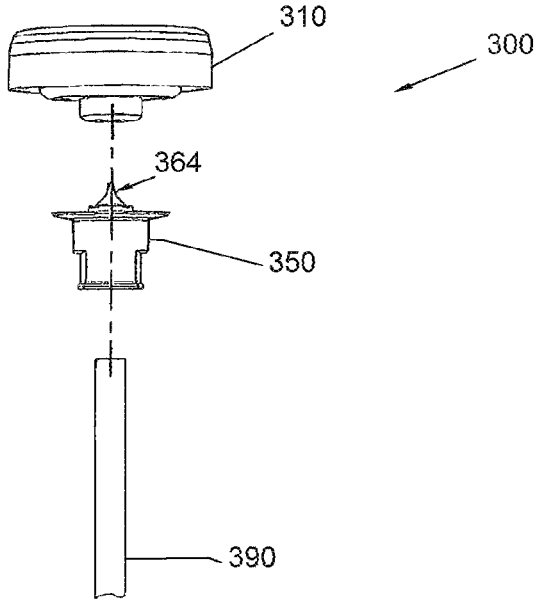
FIG. 22 is an exploded front view of the cap, valve assembly, and dip tube of the container body of FIG. 17.
Figure 23:
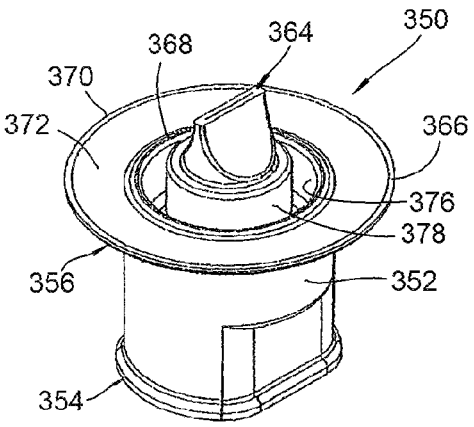
FIG. 23 is an isometric view of the valve assembly of the container of FIG. 17.
Figure 24:
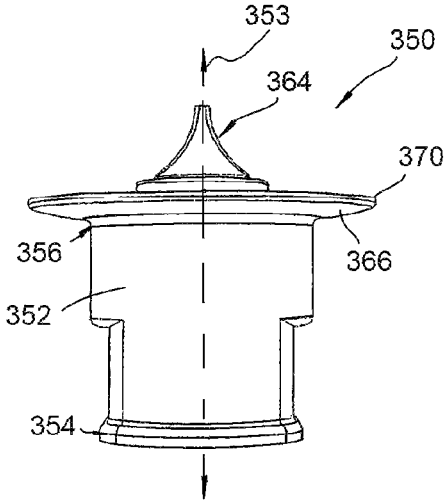
FIG. 24 is a front view of the valve of the container of FIG. 17.
Figure 25:
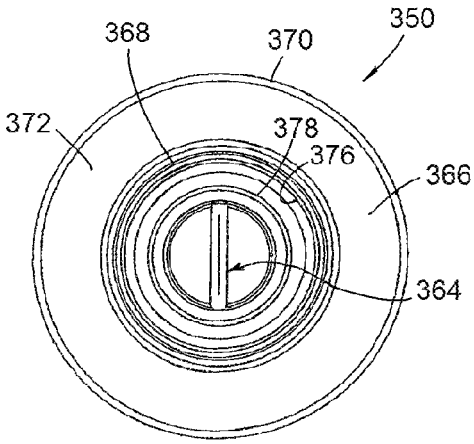
FIG. 25 is a top view of the valve of the container of FIG. 17.

Referring now to FIGS. 21-29, one way of venting and permitting access to contents of the container bodies 105, 110, 112, 114, 116 is done by way of, for example, suitable valve and dip tube assemblies. As shown in FIGS. 21-22, in this embodiment, the venting and check valve functions of this embodiment are combined into a single valve assembly 300. The valve assembly 300 additionally incorporates a dip tube such that a valve assembly 300 incorporates all of the components required by the container body 110 to properly operate within the handheld dispenser. The valve assembly 300 may be pre-assembled and inserted into each container body 110 in a single step to reduce overall assembly time and cost.

Referring now to FIGS. 21-22, the valve assembly 300 preferably includes a cap 310 and a valve body 350. In this embodiment dip tube 390 is inserted into the valve body 350. The valve body 350 includes an outer peripheral surface 352 extending generally around a central axis 353 from a first end 354 to a second end 356 opposite the first end 354. A lower surface 358 is connected to the outer peripheral surface 352 at the first end and, preferably, is generally perpendicular to the outer peripheral surface 352. An opening 360 extends through the lower surface 358 and is in fluid communication with an inner periphery 362. The cross-section of the inner peripheral surface 362 is preferably round, but alternately may be any shape. The inner peripheral surface 362 extends generally around and along with the central axis 353 from the opening 360 in the lower surface 358 and up through the valve body 350 to a slit portion 364 establishing a fluid path through the valve body 350.

Referring now to FIGS. 21-26, the valve body 300 has a flange 366 is connected to the outer peripheral surface 352 at the second end 362 and extends radially outward. The flange 366 has an inner periphery 368 and an outer periphery 370. The upper surface 372 of the flange 366 forms a concave surface between the inner 368 and outer 370 peripheries of the flange 366. The valve body 300 also includes an annular recess 374 between the inner 352 and outer peripheral surfaces 362 of the valve body 300. The annular recess 374 is configured to engage the cap 310 and extends generally around the central axis 363. The annular recess opens to the second end 356 and extends into the valve body 300 for a portion of the height of the valve body 300, for example about half of the height of the valve body 300. The annular recess 374 includes a first wall 376 and a second wall 378 each extending from the second end 356 generally into the valve body 300. The walls, 376 and 378, are spaced a first width W1 apart for a first portion and a second width W2 apart along the inner portion of the recess 374. The second width W2 is preferably greater than the first width W1 such that a channel is formed at the inner-most portion of the annular recess 374.

Shown best in FIGS. 23-26, the inner peripheral surface 352 of the valve assembly 300 may extend generally in parallel with the central axis 353 and beyond the second end 356 of the outer peripheral surface 352. The inner peripheral surface 352 preferably extends opposite of and along with the second wall 378 of the recess 374 forming a wall therebetween. Opposite sides of the wall may taper together to form the slit portion 364, forming a duck bill valve.

Referring now to FIGS. 21-22 and 27-29, the cap 310 engages the valve body 350 and preferably includes a lower 312 portion configured to extend into the annular recess 374 of the valve body 350. Preferably, the lower portion 312 has a first segment with a thickness substantially equal to the first width W1 of the annular recess 374 and a second segment wherein at least a portion of the second segment has a thickness substantially equal to the second width W2 of the channel in the annular recess. The cap 310 further includes a vent portion 314 connected to the lower portion 312 and extending radially away from the central axis 353. The vent portion 314 is configured to be adjacent to the flange 366 of the valve body 350 when the cap 310 and the valve body 350 are connected. The vent portion 314 additionally has at least one vent hole 316 extending therethrough.

Still referring to FIGS. 21-22 and 27-29, the cap 310 also includes a neck portion 320 having an inner 322 and an outer 324 surface connecting to the vent portion 314. The neck portion 320 extends away from the lower portion 312 and the inner 322 and outer 324 surface are generally parallel to each other for a first length. The outer surface 324 of the neck then tapers towards the inner surface 322 for a second length. The cap further includes a first set of tabs 326 disposed around the inner surface 322 of the neck portion 320. The first set of tabs 326 are preferably disposed within the neck 320 and around the lower end of the inner surface 324 of the neck, extending radially into the neck to engage the slit portion 364 of the valve body 350.

Figure 27:
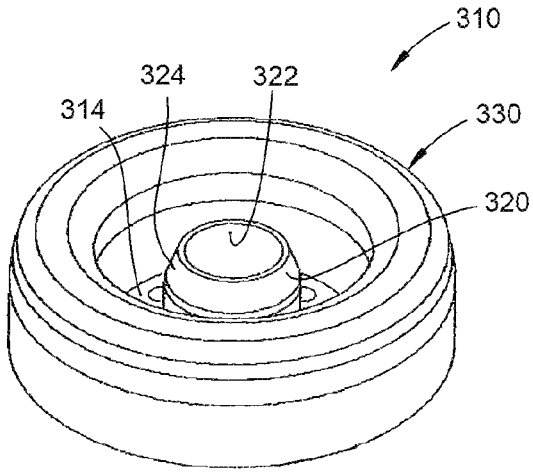
FIG. 27 is an isometric view of the cap of the container of FIG. 17.
Figure 28:
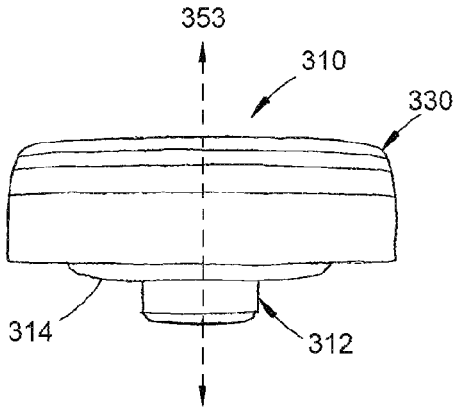
FIG. 28 is a front view of the cap of the container of FIG. 17.
Figure 29:
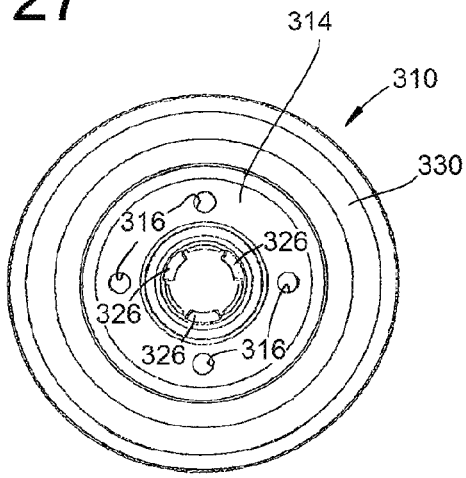
FIG. 29 is a bottom view of the cap of the container of FIG. 17.
Figure 30:
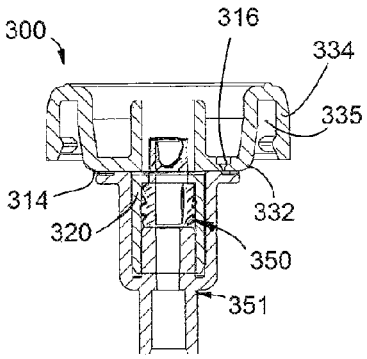
FIG. 30 is a side elevation cross-sectional view of a variant of the valve assembly of FIG. 17.
Figure 31:
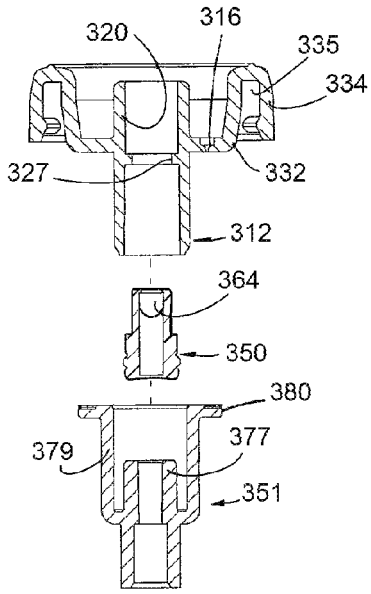
FIG. 31 is an exploded cross-sectional view of the valve assembly of FIG. 30.
Figure 32:
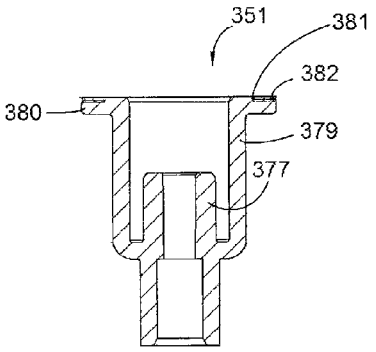
FIG. 32 is a side elevation cross-sectional view of the dip tub holder of FIG. 30.
Figure 33:
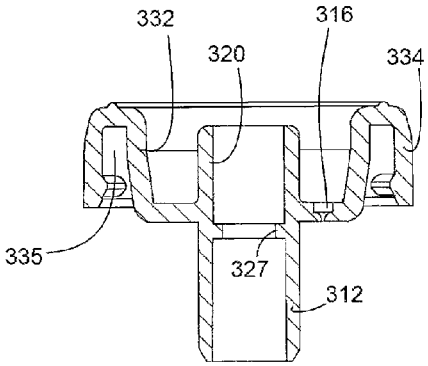
FIG. 33 is a side elevation cross-sectional view of the valve assembly cap of FIG. 30.
Figure 34:
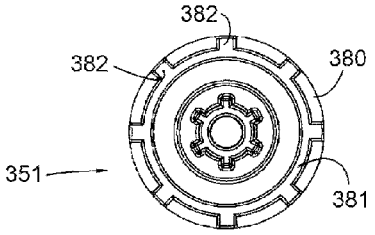
FIG. 34 is a top plan view of the dip tub holder of FIG. 30.
Figure 35:
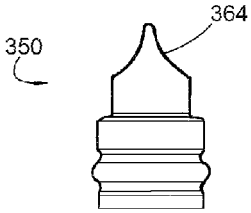
FIG. 35 is a side elevation view of the valve body of FIG. 30.

Shown best in FIGS. 27, 29, a rim portion 330 of the cap has a first wall 332 and a second wall 334. The first 332 and second 334 walls are connected at the upper ends of each wall forming a channel 335 between the two walls. The first wall 332 is connected to the outer periphery of the vent portion 314. The cap 336 second set of tabs disposed around the lower end of at least one of the first 332 and second 334 walls of the rim portion 330 and extending into the channel 335 to engage the container body 110.

Referring again to FIGS. 21-22, the valve assembly 300 preferably includes a dip tube 390. The outer diameter of the dip tube 390 is substantially equal to the diameter of opening 360 in the lower surface 358 of the valve body 350. A first end of the dip tube 390 is inserted through opening 360 in the lower surface 358 and into the along the inner peripheral surface 352 of the valve body 350. The second end of the dip tube 390 extends downward into the container. Preferably, a seat 340 is included around the inner peripheral surface 352 of the valve body 350 such that the dip tube 390 is inserted into the valve body 350 until it engages the seat 340.

Referring once again to FIGS. 21-29, in operation, the valve assembly 300 of this embodiment operates to provide three basic functions. The valve assembly 300 serves as a first check valve which permits fluid contained within the container body 110 to be drawn up into the venturi assembly 220 without flowing back into the container body 110. The valve assembly 330 serves as a second check valve which permits air to enter the container body 110 as the fluid is drawn out, maintaining a generally constant pressure within the container body 110. The valve assembly 300 additionally provides a means for holding the dip tube 390 which extends into the container body 110.

Still referring to FIGS. 21-29, the first check valve is the slit portion 364 of the valve body 350. An operator activates the hand-held device, either manually or automatically, causing fluid, preferably water from the reservoir 50 to enter the venturi assembly 220. The pressure differential in the venturi assembly 220 causes fluid to be drawn up the dip tube 390 and through the slit portion 364 of the valve assembly, mixing with the water in the venturi assembly 220 prior to exiting the hand-held device. When no fluid is being passed through the venturi assembly 220, the pressure is equalized on either side of the slit portion 364 such that the slit portion 364 remains closed, preventing the mixed solution from draining back into the dip tube 390 and down into the container body 110.

Still referring to FIGS. 21-29, the second check valve is the flange 366 portion of the valve body 350. The flange 366 functions as an umbrella valve, allowing air to enter container body 110 as fluid exits through the slit portion 364. As fluid is drawn out of the container body 110, a vacuum begins to be established inside the container body 110. When the differential between the pressure inside the container body 110 and the outside atmospheric pressure is great enough, the outer periphery 370 of the flange 366 is drawn away from the cap 310, establishing a fluid path between the outside atmosphere through the vent holes 316 of the cap 310 into the container body 110. Once the pressure differential has been reduced, the outer periphery 370 of the flange 366 reseats against the cap 310 sealing off the fluid path and preventing fluid from leaking out through the vent holes 316. Throughout the process, the inner periphery 368 remains in contact with the cap 310, providing a constant seal between the valve body 350 and the cap 310.

Referring now to FIGS. 30-35, this embodiment does not include an umbrella valve-like configuration for venting. Instead, the vent portion 314 of the cap 310 includes a single pinhole-type vent hole 316. Vent hole 316 preferably has an opening width of less than about 0.010 inch, preferably about 0.007 inch in diameter at its narrowest portion and which may frustoconically taper down to the narrowest portion from a counter bore that is less than about 0.050 inch and preferably about 0.040 inch in diameter.

Still referring to FIGS. 30-35, in this embodiment, a dip tube holder 351 is provided that is separate from the valve body 350 and which connects to the cap 310 to hold the valve body 350 therebetween. Instead of tabs 326 (as shown in FIG. 29), the cap 310 includes a rib 327 that extends radially inward from the inner circumferential surface of the neck 320, generally separating the neck 320 from the lower portion 312. Valve body 350 of this embodiment also has a duck bill valve configuration, with a slit portion 364 at its top end. The valve body 350 is inserted into the bottom of the lower portion 312 so that a shoulder of the valve body 350 abuts the rib 327 from below. The dip tube holder 351 retains the valve body 350 in position from below, with an inner wall 377 that extends inside of the lower portion 312 and an outer wall 379 that extends outside of the lower portion 312, squeezing it therebetween. A flange 380 extends radially from the top of the outer wall 379 of the dip tube holder 351. A circular groove 381 extends into an upper surface of the flange 380 and concentrically about a central axis of the dip tube holder 351. In the complete assemblage, the circular groove 381 is positioned directly below the vent hole 316 and multiple vent groove 382 extend radially out from the circular groove 381 to the perimeter of the flange 380. In such configuration, regardless of the where the vent hole 316 is positioned angularly with respect to the dip tube holder 351, the vent hold 316 will be vented to the ambient by the passageway of the circular and vent grooves 380, 382.

Figure 15:
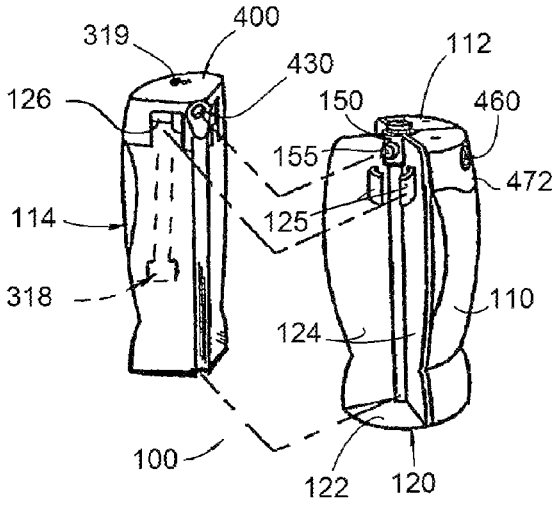
FIG. 15 is a pictorial view of a container assembly of the present invention that incorporates multiple container bodies, with two container bodies removed.

Referring now to FIG. 15, in this alternative embodiment, one way of venting and permitting access to contents of the container bodies 105, 110, 112, 114, 116 is by way of a dip tube assembly 318 and a vent mechanism 319. The dip tube assembly 118 and/or vent mechanism 319 allow the container bodies 105, 110, 112, 114, 116 to be liquid tight while reducing incidences of spilling when they are tipped or turned upside down, all while ensuring a quick response to trigger 30 actuation or other dispensing technique.

Still referring to FIG. 15, dip tube assembly 318 includes a dip tube or other tubing-type segment that permits access to the container contents and a cooperating check valve, are housed in the container bodies 105, 110, 112, 114, 116. The dip tube assembly 118 is configured to convey the concentrate "C" out of the container bodies 105, 110, 112, 114, 116, explained in greater detail elsewhere herein, while ensuring that the dip tube remains full of concentrate "C" for quick concentrate "C" delivery without priming. Container assemblies 100 of this embodiment includes vent mechanisms 319 that serve as both vents and checkvalves for the container bodies 105, 110, 112, 114, 116 while noting that in other embodiments, separate and distinct vents are checkvalve are incorporated in lieu of an integral or unitary multifunctional vent mechanism 319. Vent mechanism 319 is configured to air to enter the interior portion of container bodies 105, 110, 112, 114, 116 while the concentrate "C" is being dispensed. This maintains the desired pressure within the container bodies 105, 110, 112, 114, 116 by replacing the volume that occupied by the dispensed concentrate "C," preventing undesired vacuum buildup within the container bodies 105, 110, 112, 114, 116. Preferably the vent mechanism 319 is made from a GORE-TEX® venting material, sintered-type or other suitable materials, optionally, vents, pinholes, and/or other mechanisms that permit air to enter but prevent concentrate "C" from escaping the container bodies 105, 110, 112, 114, 116.

Referring again to FIGS. 1, 4-7, and 15-16, regardless of the particular venting configuration(s) of the container assembly 100, the multiple container versions preferable include a rotating frame 120 in which the container bodies 110, 112, 114, 116 are mounted and through which they can operable interact with other components of the device 10. In such configurations, e.g., by way of rotating frame 120, the container assembly 100 in its entirety can be pivotally or rotatably connected by opposite ends thereof to the housing 20. The container assembly 100 preferably pivots or rotates while defining discrete positions throughout the range of rotation.

The discrete positions can be defined by, for example, detents, or other mechanical structures that enable a user to index between such use positions for selecting the desired concentrate "C" and thus the desired end use product. Optionally, various printed or other indicia can be provided upon portions of the housing 20, e.g., upon the upper and/or lower retaining flanges 90, 92, to facilitate visual alignment of the desired or selected container body 110, 112, 114, 116.

Still referring to FIGS. 1, 4-7, and 15-16, the rotating functionality of the container assembly 100 enables a user to singularly or selectably align any one of the container bodies 110, 112, 114, 116 with the reservoir 50. For example, the selected container body 110, 112, 114, 116 and its respective concentrate "C" is operably connected such that the diluent "D" of reservoir 50 mixes with the concentrate "C" during the momentary dispensing act, whereby the desired end use product is directed out of the dispensing device 10. Namely, the user rotates the container assembly 100 about the axis of rotation of the rotating frame 120 so that the desired container body 110, 112, 114, or 116 faces directly forward, aligning the desired container body or cooperating components with, e.g., the pump outlet tubing 84, explained in greater detail elsewhere herein.

Referring now to FIGS. 15-16 and 36-37, in this embodiment, the axis of rotation of rotating frame 120 can be maintained in a substantially constant position by providing a fixed stem 165 (FIG. 36-37) about which the rest of the rotating frame 120 rotates. Shown best in FIGS. 36-37, fixed stem 165 has a bottom end with pockets 166 that accept corresponding prongs 167 of a base 162 that is provided within the main body segment 22 and supports the rotating frame 120 from below. Prongs 167 in this embodiment are spaced from each other in a generally circular arrangement and the prongs 167 extend angularly down so that their tips point toward an axis of the circular arrangement. In this configuration, the prongs 167 generally define a conical taper that extends downwardly into the base 162. In this configuration, during initial installation of the stem 165, the stem's 165 bottom end is pushed into the base 162 so that the prongs 167 deflect or flex outwardly, with their tip ends moving radially outward from the axis of the circular arrangement of the prongs until they restore and snap into the pockets 166. When the prongs 167 snap into the pockets 166, the prongs 167 lock the stem 165 both axially and rotationally in a fixed position with respect to the device 10 in a manner that ensure that the relative positions of the container bodies 110, 112, 114, 116 between the divider walls 124 stay fixed with respect to other components of the device 10, while allowing them to rotate about the axis of rotation.

Figure 16:
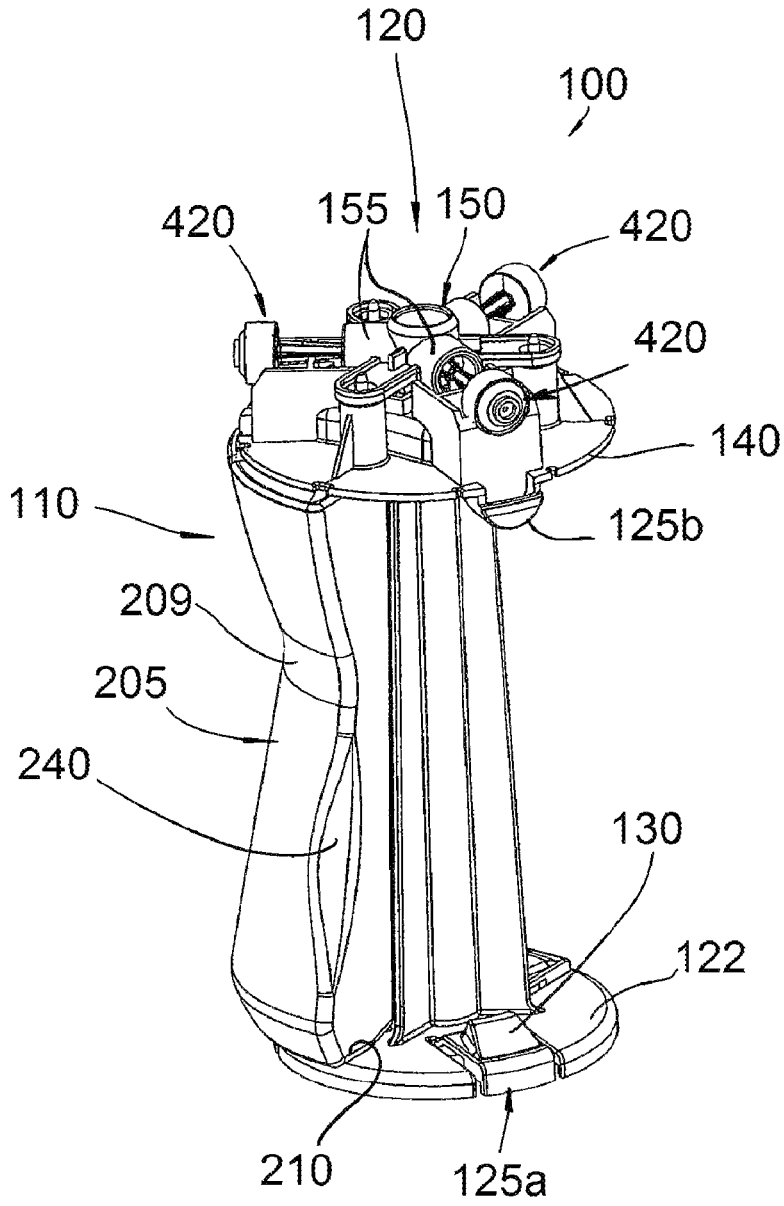
FIG. 16 is a perspective view of an embodiment of a rotating frame assembly of the dispensing device of FIG. 1.
Figure 17:
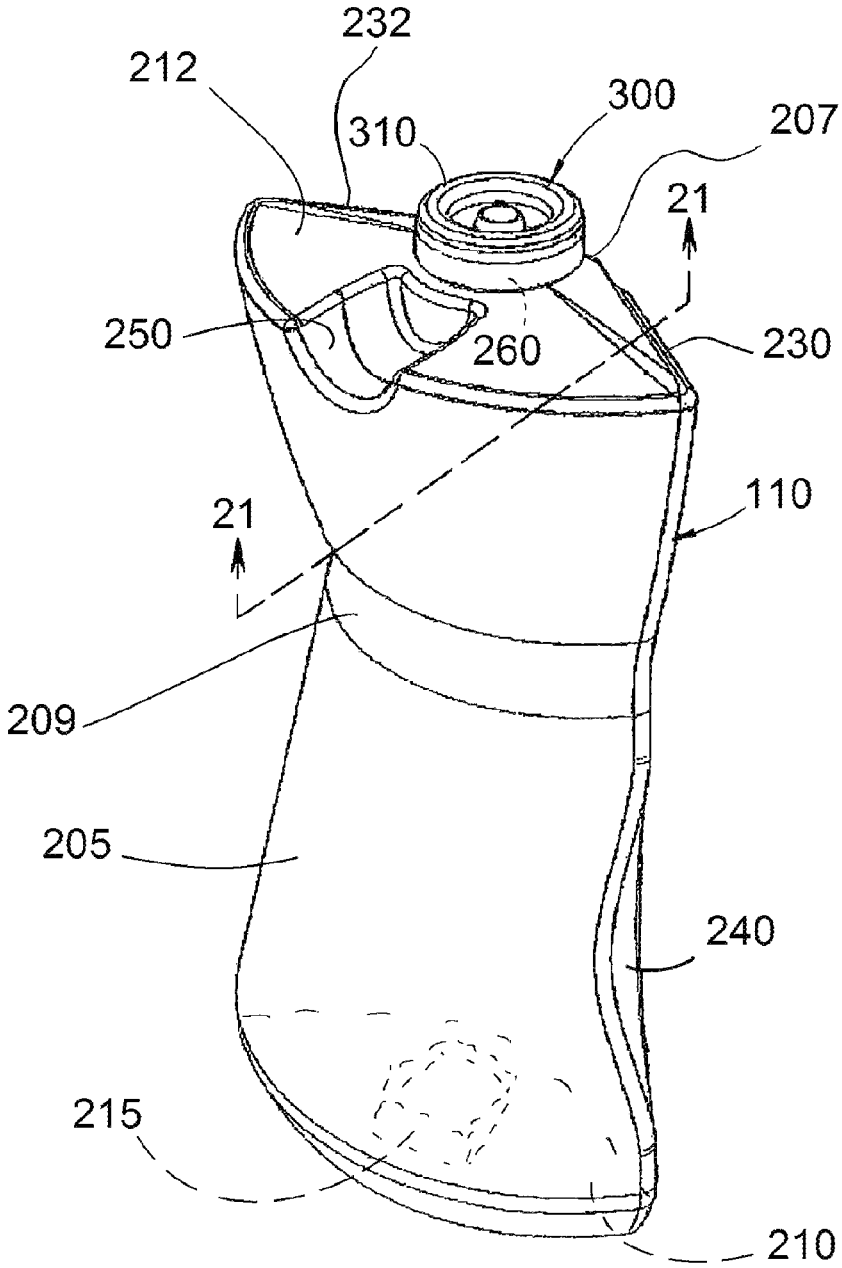
FIG. 17 is an isometric view of a container body of the present invention.
Figure 36:
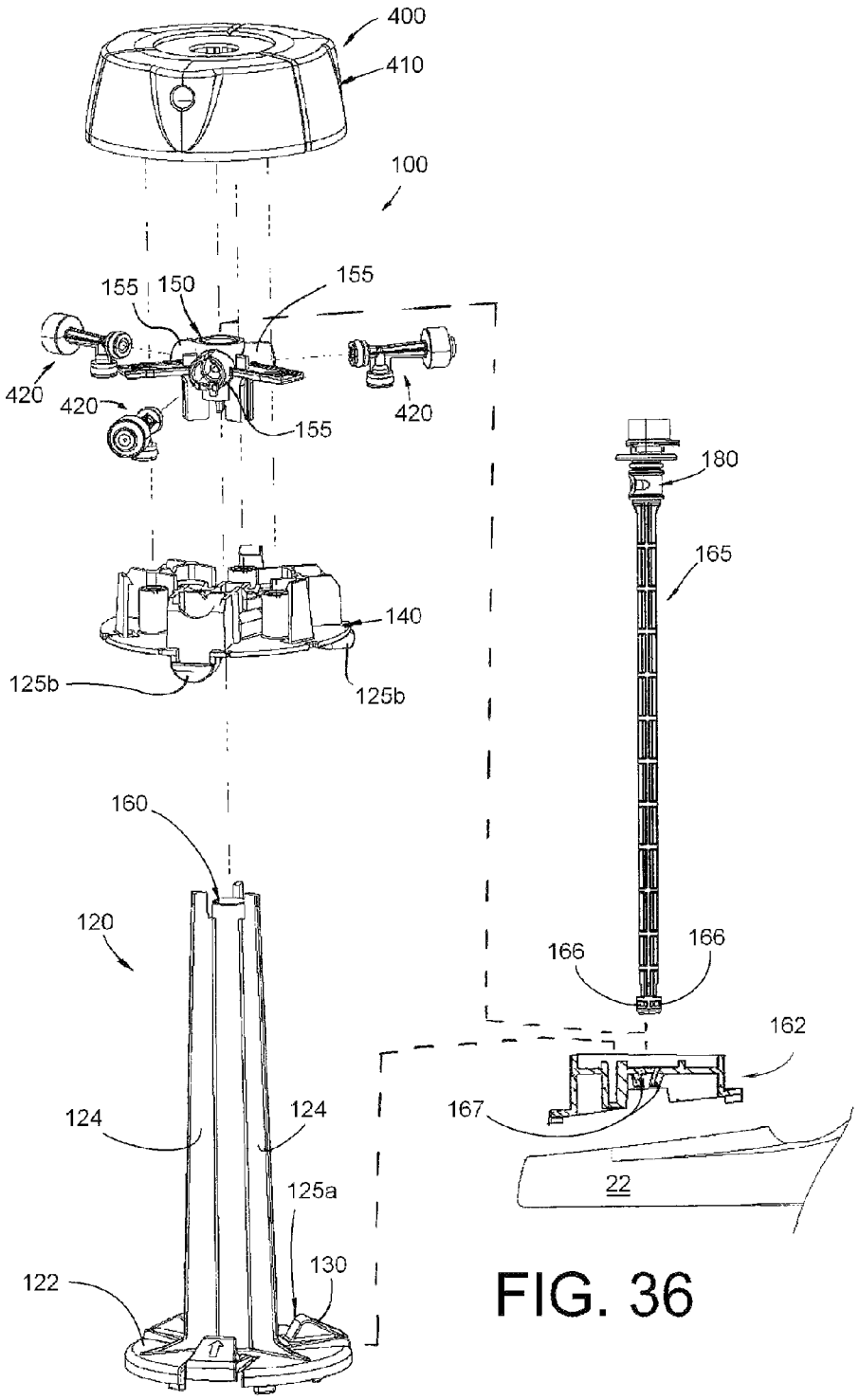
FIG. 36 is an exploded cross-sectional view of the rotating frame assembly of the dispensing device of FIG. 1.

Referring now to FIGS. 15-16 and 36, rotating frame 120 has a generally planar bottom wall 122 that has a generally circular perimeter shape. Multiple divider walls 124 extend upwardly from the bottom wall 122, intersecting each other and defining spaces therebetween that rotate about the axis of rotation of the rotating frame 120. It is in these spaces between adjacent divider walls 124 that the container bodies 110, 112, 114, 116 are housed while being allowed to rotate about the axis of rotation of the rotating frame 120.

Referring still to FIGS. 15-16 and 36, whereas the divider walls 124 of FIG. 15 extend from the middle of the rotating frame 120 all the way across the bottom wall 122, as shown in FIGS. 16 and 36, in these embodiments, the divider walls 124 are less wide than those of FIG. 15. As shown in FIG. 16, in this embodiment, each divider wall 124 extends only partway across back or sidewalls of the container bodies 110, 112, and 114. For example, the divider walls 124 extend less than halfway across a widest portion of the container body back or side wall. The divider wall may fit within a recess of the container body back or side wall that has the same perimeter shape as the divider wall 124, so that an outer edge of the divider wall abuts a shoulder defined between the recessed portion and the remainder of the container body back or side wall. The depth of such recess can be half of the thickness dimension of the divider wall 124 so that a single divider wall can fit into recesses of adjacent container bodies 110, 112, and 114 and support them each from opposing surfaces.

Referring now to FIG. 36, divider walls 124 of this embodiment radiate from a cylindrical core 160 that is mounted concentrically around the stem 165, and have similarities to certain portions of those in FIGS. 15 and 16. In this embodiment, the divider walls 124 are narrow so as to extend a relatively short radial distance from the axis of rotation, similar to those of FIG. 16, for most of their heights. However, the bottom portions of the divider walls 124 extend all radially across the entire upper surface of the bottom wall 122. These wider bottom portions of the divider walls mechanically guide the bottoms of the container bodies 110, 112, 114 into proper alignment while inserting them into the rotating frame 120.

Referring again to FIGS. 15-16 and 36, the container bodies 110, 112, 114, 116 can be removably housed in the rotating frame 120 by way of, e.g., friction fit, snap-lock, and/or other mechanical temporary holding techniques and corresponding interfaces. As shown in FIG. 15, one suitable way to configure a snap-lock arrangement is by providing one or more projection 125 can extend from one or more of the divider walls 124. One or more receptacles 126 can extend into, e.g., back, side, or other corresponding surfaces of the container bodies 110, 112, 114, 116 or components attached thereto. In this configuration, the container body 110, 112, 114, 116 is installed by placing it into a space between adjacent divider walls 124, the projections 125 are aligned with the receptacles 126, and the container body 110, 112, 114, 116 is urged into place so that it nests snugly within such space. Urging the container body 110, 112, 114, 116 into place in this manner e.g., forces the projections 125 to resiliently flare outwardly as they slide through the receptacles 126 and over corresponding structure within the container body 110, 112, 114, 116. Once they clear or slide sufficiently far over such structure, the projections 125 bias back inwardly. This defines the snap-lock holding arrangement between the rotating frame 120 and the container body 110, 112, 114, 116. Other snap-lock and/or other temporary holding structures are contemplated and well within the scope of the invention, including but not limited to, e.g., various flex tabs and apertures, detents, external latches, and/or others as desired, which permit the removable attachment of the container body 110, 112, 114, 116 to the rotating frame 120, at least some of which are described in greater detail elsewhere herein.

Referring now to FIGS. 16 and 36, container assembly 100 of this embodiment is configured to hold three container bodies 110, 112, and 114, and they are held in a rotating frame 120 that mechanically locks them in place in a different manner than those shown in FIG. 15. Container assembly 100 of FIGS. 16 and 36 has multiple features, at top and bottom portions thereof, that interlock with the container bodies 110, 112, and 114 from above and below. Instead of prong-like projections like those of FIG. 15, as projection or interlock structures, bottom wall 122 can include a resilient member such as flexible tab 125*a* that biases the container assembly 100 upwardly, retaining it in place. Referring still to FIGS. 16 and 36 flexible tab 125*a* resiliently pivots about an axis defined by a line of attachment between it and the bottom wall 122 of the rotating frame 120. Cutaway voids extend along the sides of the flexible tabs 125*a*, extending radially through a major portion of the bottom wall 122, ending less than one-quarter of an inch from the stem or center of the rotating frame 120. Flexible tab 125*a* can include a ramped projection 130 extending upwardly therefrom and interlocking with the lower locking receptacle 215 that extends into a lower wall 210 of the container body 110, 112, and 114 (FIGS. 19 and 20). The ramped projection 130 can be generally triangular when viewed in a side elevation, with a relatively more gradual slope at a surface facing away from the rotating frame 120 and a relative steeper slope at a surface facing toward the rotating frame 120. Preferably main body segment 22 of the housing 20 accommodates actuation of flexible tab 125*a* by including a depression or cutaway at a front portion that allows an aligned tab 125*a* to be pushed downwardly thereinto. In this configuration, only the particular tab 125*a* that is aligned with such depression can be actuated, whereas tabs 125*a* that are not so aligned are mechanically prevented from moving downwardly to an extent that would release the container bodies 110, 112, and 114, reducing a likelihood of non-desired container body 110, 112, and 114 removal.

Still referring to FIGS. 16 and 36, tabs 125*a* can be positioned with respect to the thumb depressions 240 (FIG. 16) so as to allow users to grasp lower portions of the container bodies 110, 112, and 114 near locations at which they release the container bodies 110, 112, and 114 from the tabs 125*a*. This may provide a comfortable gripping position in which the user can initiate prying such bottom portion of the container bodies 110, 112, and 114 out from the rotating frame 120 during their removal.

Referring still further to FIGS. 16 and 36, rotating frame 120 in this embodiment includes a top plate 140 that extends parallel to the bottom wall 122 and supports the container bodies 110, 112, and 114 from above. In some embodiments, an upper locking projection 125*b* extends downwardly from the top plate 140. Upper locking projection 125*b* can have an arcuate bottom wall that extends between and connects opposing sidewalls, defining a downwardly facing semicircular perimeter shape, when viewed from a front elevation. Regardless of the particular shape of the upper locking projection 125*b*, it is configured to fit into a corresponding recess or upper locking receptacle 250 (FIGS. 18-20) that extends into an upper wall 212 of the container bodies 110, 112, and 114, such that outer surfaces of the upper locking projection 125*b* abut or interface cooperating surfaces of the container upper wall receptacles. In some embodiments, the top plate 140 serves as a mounting structure for, or is integrated with, an outlet assembly 400 which is explained in greater detail elsewhere herein.

In yet other embodiments, container assemblies 100 having multiple container bodies 110, 112, 114, and 116 do not have to rotate about a vertical axis such as those illustrated in FIGS. 1, and 4-7, but can have other configurations depending on the intended end use design of dispensing device 10. Regardless of the particular configuration of dispensing device 10, the container assemblies 100 that utilize multiple container bodies 110, 112, 114, 116 are configured so that at any give time, a single container body 110, 112, 114, 116 is fluidly connected to, e.g., reservoir 50, allowing the diluent "D" and selected concentrate "C" to mix with each other during the dispensation act, exiting the dispensing device 10 as the intended end use product.

Figure 8:
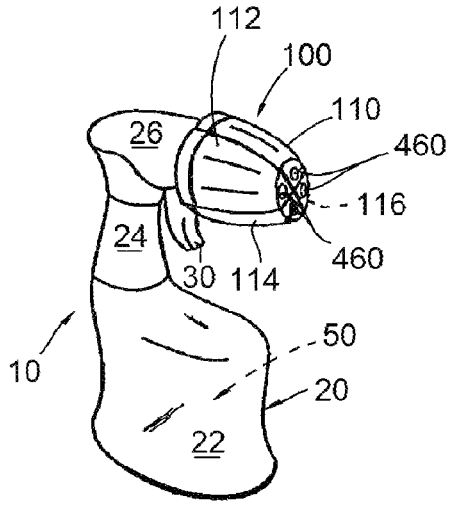
FIG. 8 is a perspective view of a fifth embodiment of a dispensing device of the present invention.

For example, FIG. 8 illustrates another embodiment of container assembly 100 that rotates for selecting the desired container bodies 110, 112, 114, 116, and corresponding concentrate "C" and end use product. However, the container assembly 100 seen in FIG. 8 rotates about a horizontal axis of rotation in lieu of a vertical axis of rotation such as those of FIGS. 1, and 4-7.

Figure 9:
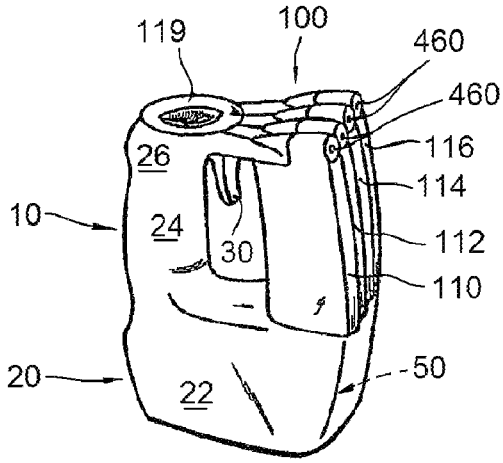
FIG. 9 is a perspective view of a sixth embodiment of a dispensing device of the present invention.

FIG. 9 depicts a further alternative embodiment of the container assembly 100 wherein the container bodies 110, 112, 114, 116 are still removably connected but remain stationary with respect to housing 20. In such embodiment, instead of aligning a movable container body 110, 112, 114, 116 with the pump outlet tubing 84, the pump outlet tubing is itself movable and can be selectively aligned with the desired (fixed or stationary) container body 110, 112, 114, 116, e.g., by way of a dial mechanism 119 or otherwise.

The alternative embodiments of FIGS. 10-11 show yet other suitable methods for aligning container bodies 110, 112, 114, 116 with the remainder of the dispensing device 10. In these embodiments, the head 60 and/or housing 20 is rotated to align corresponding conduits, passages, or other flow directing structures, permitting the diluent "D" and selected concentrate "C" to mix with each other during the dispensation act, exiting the dispensing device 10 as the intended end use product.

Referring again to FIGS. 16 and 36 and devices 10 that incorporate a rotating frame 120 to hold multiple container bodies 110, 112, 114, 116, distribution collar 150 of this embodiment is provided at the intersection of the divider walls 124, at the top end of rotating frame 120. Hollow projections or sleeves 155 extend radially from the distribution collar 150, in the spaces between adjacent divider walls 124, and bores extend through the distribution collar 150 and each of the sleeves 155, enabling fluid flow therethrough. Distribution collar 150 is configured to accept at least a portion of the downwardly extending elongate member 85 of pump outlet tubing 84 therein. Namely, the distribution collar 150 is sized and configured to cooperate with pump outlet tubing 84 so that the outlet bore 86 can be selectively aligned with one of the bores extending through the distribution collar 150 and respective one of the sleeves 155.

Figure 37:
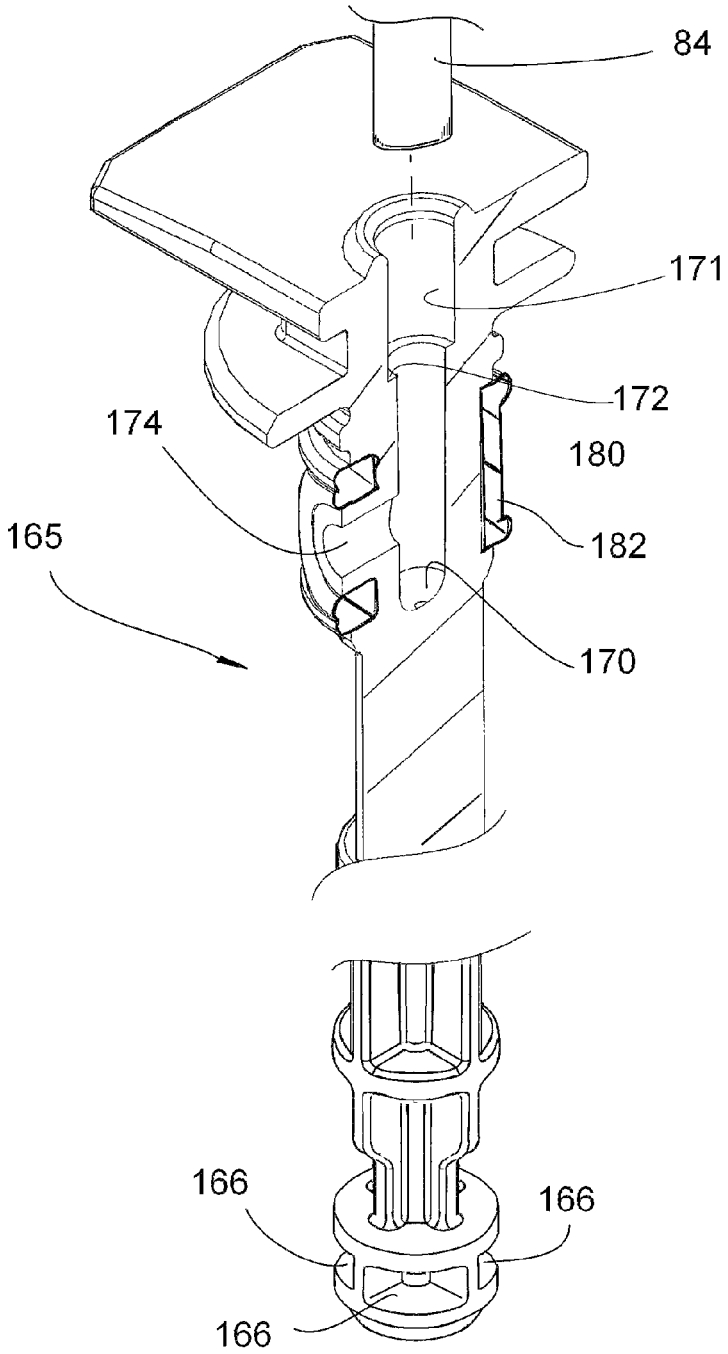
FIG. 37 is a pictorial partially cross-sectional view of a stem of the rotating frame assembly of FIG. 36.

Referring now to FIGS. 36 and 37, in this embodiment, an upper end of stem 165 couples the pump outlet tubing 84 to the outlet assembly 400. Seen best in FIG. 37, in this embodiment, a blind bore 170 extends axially into the upper end of the stem 165. A counter bore 172 extends partially along the length of the blind bore 170, so as to define a shoulder 171 therebetween. The inside diameter of the counter bore 172 corresponds to the outside diameter of the pump outlet tubing 84 so that the tubing 84 is friction or interference fit into the counter bore 172, with the end of the tubing 84 seated against the shoulder 171.

Referring now to FIG. 37, an outlet bore 174 of the stem 165 extends though the stem sidewall and radially into the blind bore 170. The outlet bore 174 aligns with the forward facing one of the venturi assemblies 420 so that whichever particular container body 105, 110, 112, 114, 116 is facing forward in the device 10 at a given time is the one that is fluidly connected to the pump assembly 35 for dispensation. In this embodiment the distribution collar 150 provides an interface between the venturi assemblies 420 and the outlet bore 174, whereby a selected one of the venturi assemblies 420 and corresponding sleeves 155 of the distribution collar 150 can be aligned with outlet bore 174 of the stem 165.

Referring now to FIGS. 37-41, a stem seal 180 ensures a liquid-tight connection between the stem 165 and thus the pump outlet tubing 84 and the selected one of the venturi assemblies 420. The stem seals 180 of these embodiments are configured to seal the distribution collar 150 in three locations and correspondingly incorporate three seals into the single unitary stem seal 180. Stem seal 180 includes a collar 182 that is concentrically mounted over the end of the stem 165. Collar 182 includes a front segment 183 that is thicker in crosssection than an opposing back segment. This configuration provides the collar 182 with an inner perimeter that has a step change in its opening radius. Upper and lower seals 184, 185 extend radially beyond an outer surface of the collar 182 at the top and bottom of the stem seal 180. Face seal 186 extends from a forward facing surface of the collar 182 and a seal opening 187 extends through the face seal 186, radially through the collar 182, and is coaxially aligned with the outlet bore 174 of the stem 165. A rib 188 extends from the lateral sides of the face collar 186 and along at least a portion of the outer circumferential surface of the collar 182.

Still referring to FIGS. 37-41, the upper and lower seals 184, 185 and the rib 188 provide vertical and transverse support to the face seal 186 which enhances the face seal's 186 resistance to deformation during use so as to maintain the integrity of the liquid-tight seal between the pump outlet tubing 84 and the outlet assembly 400 during use, for example as it is seated against an inner circumferential surface of the distribution seal 155. Rib 188 can enhance or cooperate with the sealing ability of face seal 186 by, for example, ensuring that fluid which may leak past the face seal 186 will be captured by the rib 188 and not leak throughout the distribution ring 150 and into the non-selected (non-aligned or forward facing) venturi assemblies 420.

Figure 38:
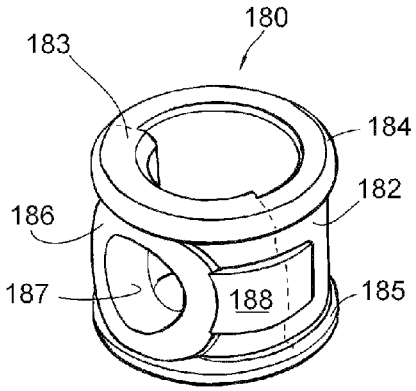
FIG. 38 is a pictorial view of a stem seal of the rotating frame assembly of FIG. 36.
Figure 39:
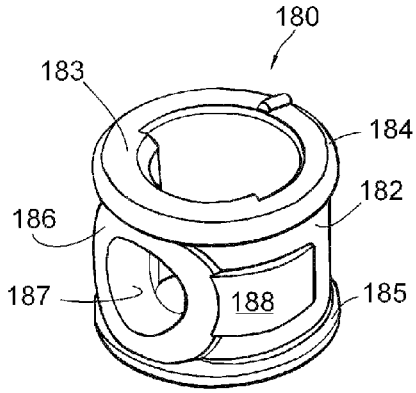
FIG. 39 is a pictorial view of a variant of the stem seal of FIG. 38.
Figure 40:
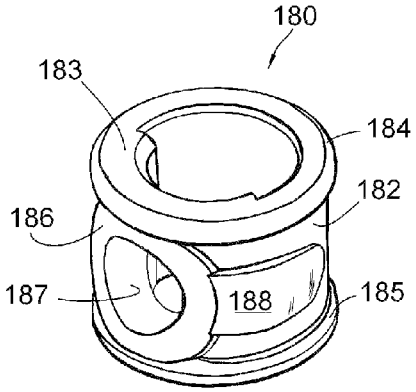
FIG. 40 is a pictorial view of another variant of the stem seal of FIG. 38.
Figure 41:
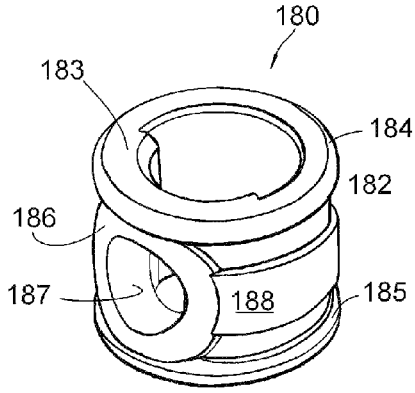
FIG. 41 is a pictorial view of another variant of the stem seal of FIG. 38.

FIGS. 39-41 show variants of the stem seal 180 shown if FIG. 38. FIG. 40 shows an embodiment having ribs 188 with rounded ends, FIG. 39 shows an embodiment having a ridge at a back portion its top wall for maintaining an angular position of the seal 180 upon the stem 165, and FIG. 41 shows an embodiment having a single rib 188 that extends entirely around the collar 182, connected the sides of the face seal 186 to each other.

In other embodiments, the stem seal 180 is directly incorporated onto the stem 165 itself, for example, by an elastomeric overmolding and/or other suitable procedure. In some such embodiments, less than the entire stem seal 180 is overmolded onto the stem 165, for example, one or more of the upper, lower, and face seals 184, 185, 186 are overmolded onto the stem 165 while any that are not overmolded may then be provided as a separate and distinct seal component(s). In yet another embodiment, all of the upper, lower, and face seals 184, 185, 186 are separate seal components that are mounted to the stem 165.

Referring now to FIG. 38, in an alternative embodiment, the collar 182 has a generally vertical or other split that allows the collar 182 to open at such split and slide in a radical direction over the top end of the stem 165, optionally, to create a larger opening at the bottom of the stem seal 180 when the back ends of the collar 182 are split so as to provide easy insertion of the collar 182 over the top end of stem 165 in an axial direction with respect thereto. Such a split is shown in-phantom line format by the dashed line extending vertically down the back of the collar 182, opposite the seal opening 187.

Still referring to FIG. 38, in another alternative embodiment, the stem seal 180 has a more plate or half-sleeve configuration, whereby unlike collar 182 that extends about the entire circumference of the stem 165, this embodiment is substantially just the front segment 183 of the collar 182, preferably having a sweep angle of more than about 100 degrees and more preferably a sweep angle of about 120 degrees. Such configuration is shown by the in-phantom line format by the two dashed lines extending vertically down the sides of the collar 182, on opposing sides of the seal opening 187 and which generally represent where the wall of the seal 180 of such embodiment may end. In a variant of such embodiment, the upper and lower seals 184, 185 on each end of the wall may be connected to each other through a vertically extending seal segment that extends in front of and adjacent to the respective end so as to reduce a likelihood of any fluid from leaking out through or past the ends of the wall and through the distribution ring 150 and into the non-selected (non-aligned or forward facing) venturi assemblies 420.

Referring again to FIGS. 37-41, regardless of the particular configuration of the stem seal 180, the stem seal is configured to provide a relatively high pressure sealing capability by way of a simple and cost-effective configuration. Stem seal 180 in each of these embodiments is configured to provide a sufficiently liquid tight seal between the stem 165 and the distribution collar 150 while enduring operating pressures of at least about 60 psi and preferably at least about 90 psi during use or at least during discrete dispensing acts in which the trigger of device 10 is being actuated.

Regardless of the particular implementation of container assembly 100, e.g., whether it includes a single container body 105 (FIG. 2) or multiple container bodies 110, 112, 114, and 116, each container body 105, 110, 112, 114, and 116 includes an outlet assembly 400 that is configured to permit the independently stored and maintained diluent "D" and concentrate "C" to mix with each other during the dispensation act or process, exiting the dispensing device 10 as the intended end use product.

Referring now to FIGS. 15 and 42-45, outlet assemblies 400 are provided above the rotating frames 120 in these embodiments, and lie between and provide the interface between the reservoir 50 and the respective container bodies 105, 110, 112, 114, 116. Each outlet assembly 400 includes a cap 410 that houses a venturi assembly 420 and, optionally, a drip catch 472. Drip catch 472, shown in FIG. 15, can include, e.g., an aperture extending through a front wall of cap 410. Drip catch 472 is adapted and configured to collect or convey residual drips from nozzle 460. Preferably an absorbent material is housed within the cap 410 behind the drip catch 472, whereby residual drips are wicked into the drip catch 472 and removed from the front surface of cap 410 without requiring user manipulation. The residual drips can be stored in the absorbent material or drain back into the respective container body 105, 110, 112, 114, 116, depending on the particular configuration of the drip catch 472.

Figure 26:
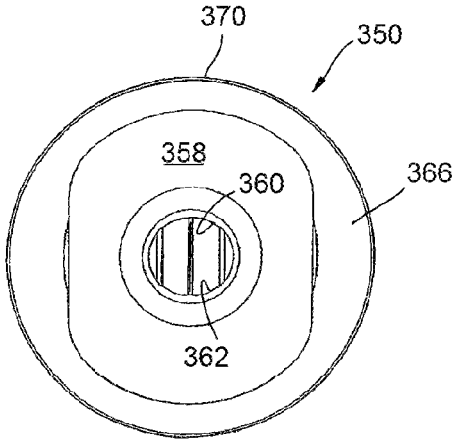
FIG. 26 is a bottom view of the valve of the container of FIG. 17.
Figure 42:
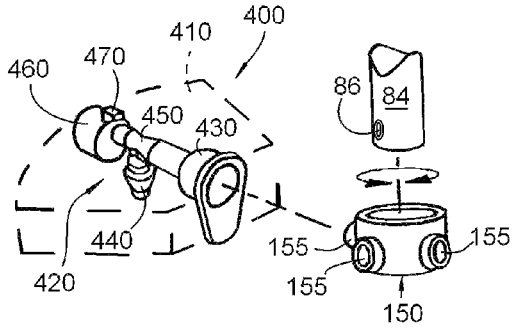
FIG. 42 is an exploded, perspective view of an outlet assembly of the container assembly of FIG. 15.
Figure 43:
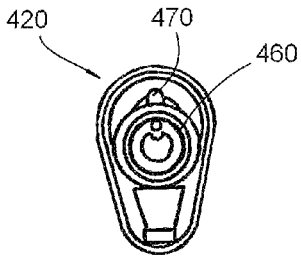
FIG. 43 is a front elevation view of the venturi assembly of FIG. 42.
Figure 44:
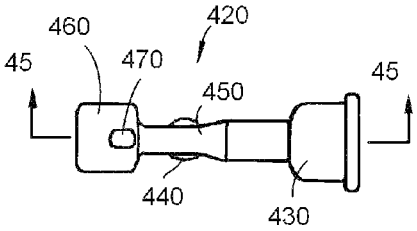
FIG. 44 is a top, plan view of the venturi assembly of FIG. 42.

Referring still to FIGS. 15 and 42-45, caps 410 sit atop the container bodies 105, 110, 112, 114, 116 and are generally hollow structures configured to fixedly, optionally removably house the venturi assembly 420 therein (FIG. 42). The cap 410 is configured to cooperate and interface with other components of the dispensing device, e.g., pump outlet tubing 84, to ensure a sufficiently sealed connection therebetween and permit fluid flow from the reservoir 50 through the outlet assembly 400. As desired, various O-rings, seals, and/or other hardware can be provided within or adjacent the cap 410 to enhance the sealed interface or connection between the pump outlet tubing 84, namely, the outlet bore 86 thereof and the venturi assembly 420 (FIG. 26). In some implementations, the caps 410 are fixed to, or integrated with, the container bodies 105, 110, 112, 114, 116.

Referring now to FIG. 36, in some embodiments, the caps 410 are connected to the top plate 140 of the rotating frame 120. In such configuration, when concentrate "C" is depleted from a container body 110, 112, 114, then the container itself is removed from the rotating frame 120 while leaving the cap 410 and remainder of the outlet assembly 400 attached to the device. Preferably, a single cap 410 extends over the entire outlet assembly 400 so that a venturi assemblies 420 are all housed inside of a single enclosure defined between the cap 210 and the top plate 140 of the rotating frame 120.

Referring now to FIGS. 42-51, each venturi assembly 420 includes a diluent inlet 430, a concentrate inlet 440, a venturi portion 450, a nozzle 460, and can also include an alignment tab 470. Although being described in terms of a multiple container body version of the device, it is fully appreciated that in some embodiments (not shown) the venture assembly 420 can be incorporated into single container body versions of the device 10. Perhaps best seen in FIGS. 17 and 30, in these embodiments, the venturi assembly 420 defines a generally T-shaped configuration with the concentrate inlet 440 perpendicularly intersecting the venturi assembly 420 from below. To complete the T-shaped configuration of venturi assembly 420, the diluent inlet 430 and nozzle 460 extend generally axially away from opposing ends of the venturi portion 450.

Still referring to FIGS. 42-51, diluent inlet 430 is selectively but operably sealed to the outlet bore 86 of pump outlet tubing 84. For example, each diluent inlet 430 can be concentrically housed inside of a respective sleeve 155 of the distribution collar 150, preferably with an O-ring or other seal therebetween. In such configuration, when the outlet bore 86 of pump outlet tubing 84 is aligned with a certain sleeve 155, a liquid-tight fluid connection is established between the pump outlet tubing and the venturi assembly 420. This ensures that diluent "D" will flow through the outlet bore 86 of the pump outlet tubing 84, through the bore of the distribution collar and sleeve 155, and through venturi assembly 420 during dispensing acts or procedures.

Referring yet further to FIGS. 42-51, concentrate inlet 440, extending downwardly from the remainder of venturi assembly 220, facilitates movement of the concentrate "C" from the container body 105, 110, 112, 114, 116 into the venturi assembly 420 where it mixes with diluent "D". In some embodiments, a hose, dip-tube, piece of tubing, or other conduit-type device extends from the concentrate inlet 240 into the container body 105, 110, 112, 114, 116 opening into the volume of concentrate "C". As desired, the concentrate inlet 440 can include a hose barb or shoulder to reduce the likelihood of non-desired removal of the hose, dip-tube, or piece of tubing therefrom. This can help ensure that, during use, the concentrate "C" will be able to be drawn upwardly through the concentrate inlet 440 into venturi portion 450.

Venturi portion 450, in general, operates as a typical venturi device, according to known Bernoulli's principles, creating a pressure differential between the venturi portion 450 and the container body 105, 110, 112, 114, 116, whereby the concentrate "C" is pushed or drawn into the venturi portion 450. In other words, venturi portion 450 has first and second ends with relatively larger inner diameters that conically taper down to a reduced-diameter central segment 455.

Figure 45:
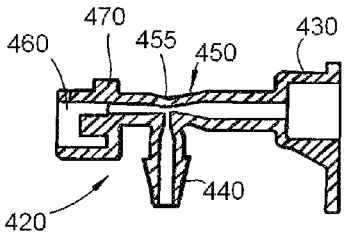
FIG. 45 is a cross-sectional view of the venturi assembly of FIG. 44 taken generally at line 45-45
Figure 49:
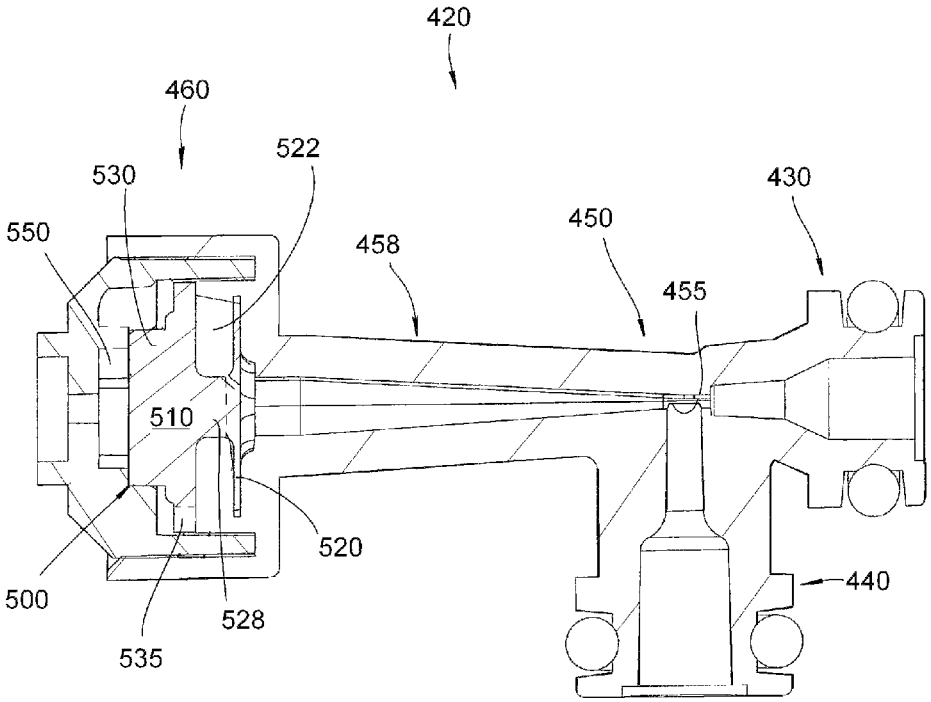
FIG. 49 is a longitudinal cross-sectional view of the venturi assembly of FIG. 46.

In this configuration, perhaps best appreciated from FIGS. 45 and 49, while traversing the venturi portion 450 from the diluent inlet 430 toward the nozzle 460, the diluent "D" increases flow velocity but decreases pressure at the reduced-diameter central segment 455. This creates a low pressure zone at the reduced-diameter central segment 455, directly above the concentrate inlet 440, and a pressure differential between the reduced-diameter central segment 455 and the respective container body 105, 110, 112, 114, 116. The pressure differential causes a volume of concentrate "C" to flow upwardly through the concentrate inlet 440, radially into the reduced-diameter central segment 455 where it mixes with the diluent "D" flowing axially through reduced-diameter central segment 455. In this regard, the concentrate "C" and diluent "D" mix together while the two fluids are being expelled from the dispensing device 10. It is noted that while a venturi-type mixing procedure is described, it is clear that alternate embodiments may utilize any style of mixing, entraining, or otherwise combining ordinarily known to one skilled in the art to achieve the same result, wherein the concentrate "C" and diluent "D" are maintained as separated, distinct entities within the dispensing device 10.

As the concentrate "C" and diluent "D" mix or combine together, they flow out of the venturi portion 450 into and through the nozzle 460 as a mixed end use product. Nozzle 460 determines the particular spray pattern and characteristics for the respective container body 105, 110, 112, 114, 116. Thus, the particular shape, dimensions, and/or other characteristics of nozzle 460 are selected based on the desired end use spray characteristics for the particular dispensed end use product.

Figure 46:
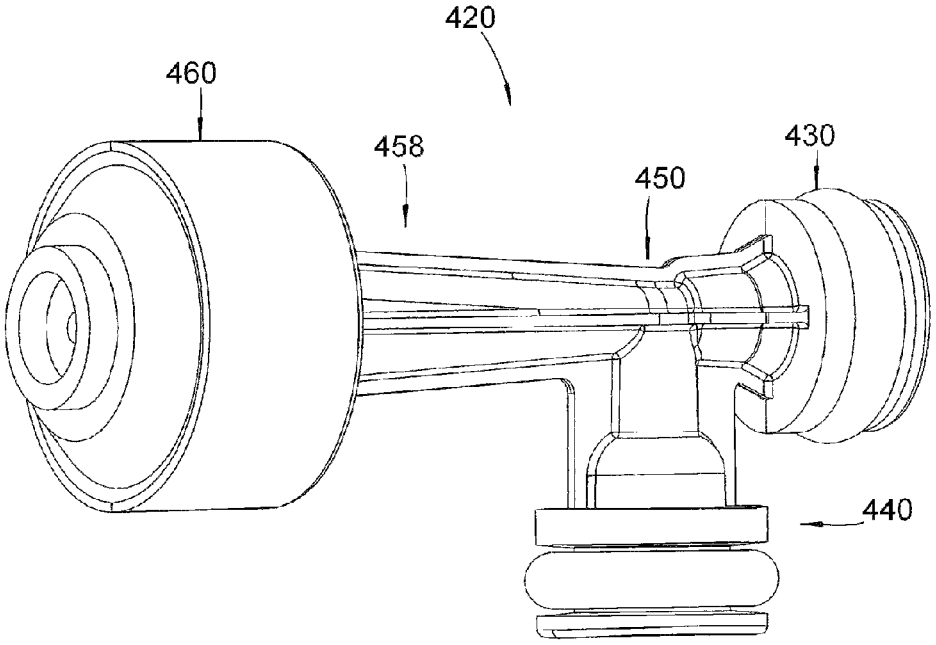
FIG. 46 is a pictorial view of a venturi assembly of FIG. 36.
Figure 47:
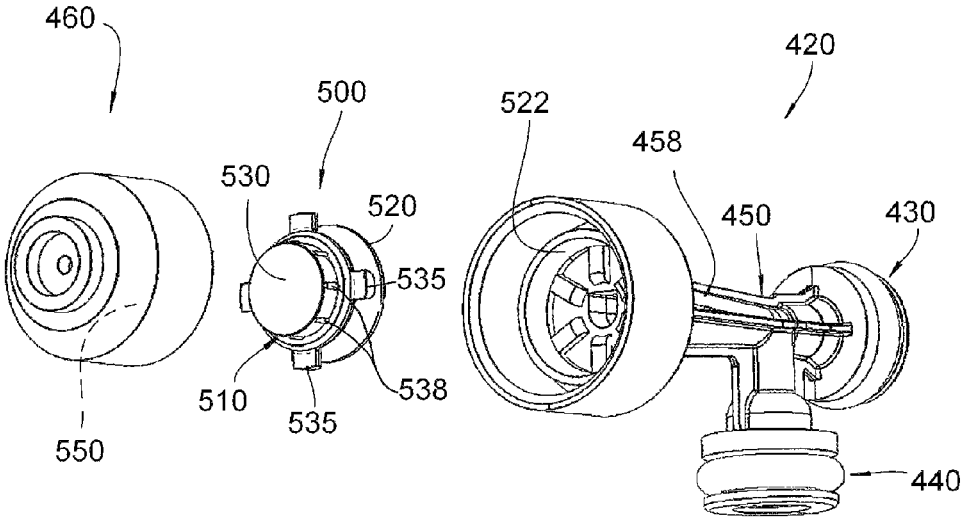
FIG. 47 is an exploded pictorial view of the venturi assembly of FIG. 46.
Figure 48:
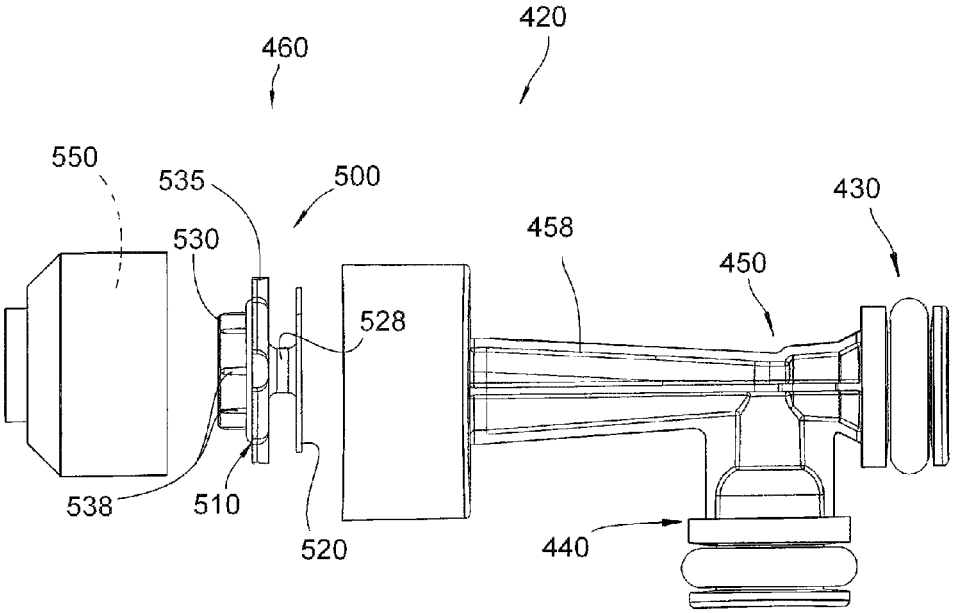
FIG. 48 is an exploded side elevation view of the venturi assembly of FIG. 46.

Referring specifically now to FIG. 46, intake side, e.g., the part of venturi portion 450 adjacent the diluent inlet 230 (the right side of venturi portion 450 as seen in FIG. 46), can be relatively larger than the output side, e.g., the part of venturi portion 250 adjacent the nozzle 460 (the left side of venturi portion 450 as seen in FIG. 46). For example, the intake side of venturi portion 450 can be at least about twice the length and at least about twice the diameter as the output side of venturi portion 450.

However, other relative dimensions of the various components of venturi assembly 420 are readily implemented as desired and well within the scope of the invention. The particular dimensions of the various components of venturi assembly 420 are based at least in part on, e.g., the desired spray pattern, the viscosity, density, and/or other characteristics that could influence flow of concentrate "C", the viscosity, density, and/or other characteristics that could influence flow of diluent "D," or other factors.

For example, and referring specifically now to FIGS. 46-51, depending on the particular desired end use flow characteristics, some embodiments of the venturi assembly 420 are configured generally the opposite to those seen in FIGS. 26-29. In other words, the venturi assemblies 420 of FIGS. 46-51 have diluent inlets 430 that are shorter than outlet portions. It is noted that the venturi assemblies of FIGS. 42-45 are nearly devoid of outlet portions, having only a short conduit segment after the central segment 450 that connects it to the nozzle 460. In contrast, the embodiments of FIGS. 46-51 have outlet segments 458 that define a major portion of an overall longitudinal length of the venturi assembly 420, for example, greater than 50 percent, greater than 60 percent, or greater than 70 percent of such overall length.

Figure 50:
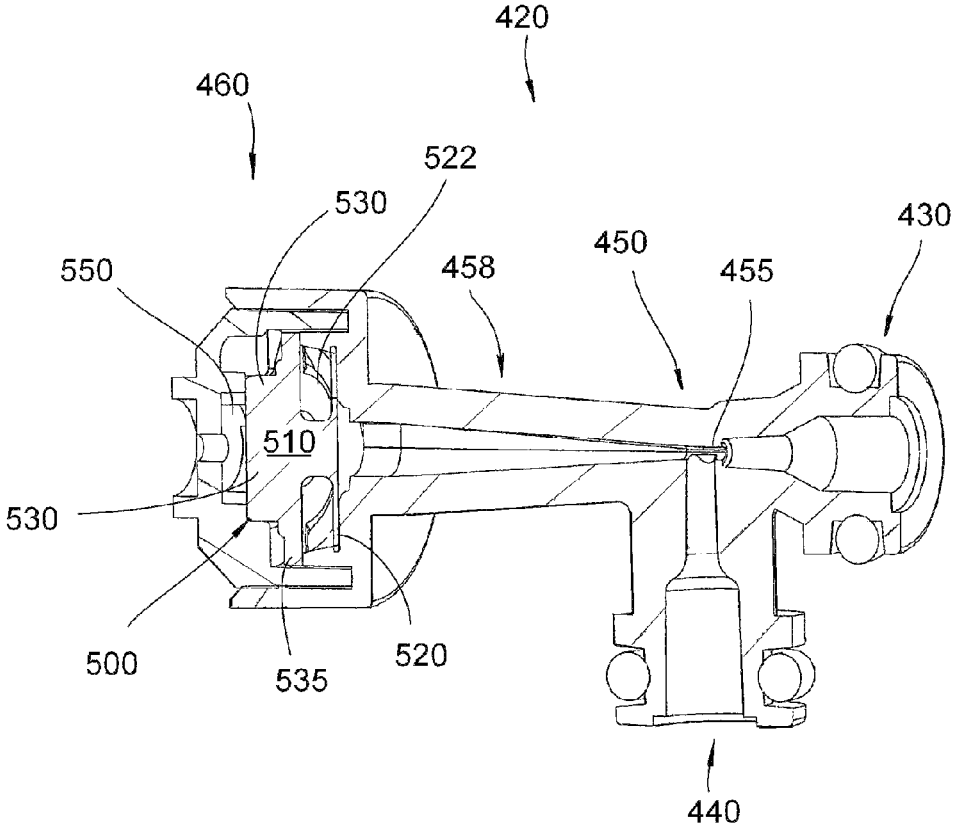
FIG. 50 is a pictorial of the longitudinal cross-section of FIG. 46.
Figure 51:
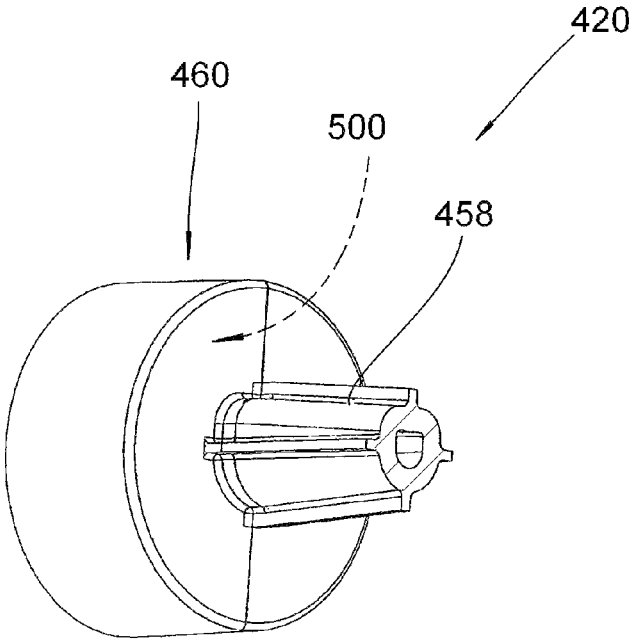
FIG. 51 is a transverse cross section of the venturi assembly of FIG. 46

Referring now to FIGS. 49-51, bores of venturi assembly 420 also differ from that seen in FIG. 45, in that the embodiments of FIGS. 49-51 have multiple differing angular tapers, different cross-sectional areas, and different perimeter shapes across their respective lengths. For example, concentrate inlet 440 has an inner diameter that rapidly reduces in size, having an arcuate sharp curving transition between its greater diameter and lesser diameter portions. Diluent inlet 430 has an opening diameter that tapers in multiple stages, at differing taper angles, toward its connection to a minimum diameter segment of the central segment 455. In this embodiment, the diluent inlet 230 reduces its diameter in two sequential tapering portions, the portion located further in the diluent inlet 430 or nearest the central segment 455 having a more gradual taper angle than the portion located furthest from the central segment 455. Through the two tapering portions, the bore of the diluent inlet 430 reduces its diameter to less than ½ of its starting value, for example tapering from about 0.1 inch down to about 0.04 inch.

Referring now to FIG. 49, a step-change diameter reduction is defined at the interface of the diluent inlet 430 and the central segment 455, such that a shoulder is defined therebetween. A ratio of the diluent inlet 430 diameter to venturi opening diameter defined at the central segment 455 can be greater than 4:3, optionally greater than 3:2, optionally greater than 2:1, or others, depending on the particular desired end use configuration. In a preferred embodiment, the diluent inlet has a diameter of about 0.04 inch at the shoulder between it and the central segment 455, whereas the venturi portion at the central segment 455 has a diameter or opening width of about 0.02 inch.

Referring now specifically to FIGS. 50-51, different portions of the longitudinal bore(s) of the venturi assembly 420 can have different perimeter shapes, when view in cross-section. Such a change in bore cross-sectional perimeter shape in this embodiment occurs at the shoulder between the diluent inlet 430 and the central segment 455. Whereas the diluent inlet 430 has a circular cross-sectional perimeter shape, the central segment 455 has a rectangular upper half and a (semi)circular lower half A pair of upright sidewalls generally orthogonally intersect the flat top wall and extends down from the top wall about half-way down the opening which in this embodiment is about 0.01 inch, preferably about 0.013 inch, which is about ½ of the width of the flat top wall, that being about 0.02 inch. At the lower part of the central segment 455 opening or bore, a curved bottom wall extends in an arc between the bottom edges of the sidewall and is radiused to define a diameter of about 0.02 inch so that the straight-line linear side walls transition smoothly to the curvilinear bottom wall of the opening or bore of the venturi portion 450. In this configuration, the opening or bore of the central segment 455 defines a "D" shaped perimeter with the curve pointing down.

Still referring to FIGS. 50-51, such downward pointing "D" shaped perimeter extends from central segment 455 along the rest of the length of the venturi assembly 420 that extends away from the diluent inlet 430. In other words, the outlet segment 458 includes the downward pointing "D" shaped perimeter of the central segment 455, while such opening increases in cross-sectional area along its length toward the nozzle 460. In preferred embodiments, such rate of increase in cross-sectional area is rather gradual, with a general tapering angle of less than about 10 degrees as seen in the sectioned view of FIG. 49. However, in this embodiment, the upper most and lower most portions of the bore of the outlet segment 458 extends at slightly different angles with respect to a central axis that is projected from the axis of the diluent inlet 230 bore. Namely, the upper wall of the bore extending through the outlet segment 258 diverges or angles upwardly from this central axis at an angle of about 3 degrees, whereas the bottom wall of the outlet segment 458 bore diverges or angles downwardly from such central axis at an angle of about 4 degrees.

Referring again to FIGS. 46-51, venturi assembly 420 can include a nozzle valve assembly 500 positioned between the longitudinal bore of the venturi assembly 420 and a swirl chamber 550 that opens into the nozzle 460 outlet. Nozzle valve assembly 500 includes a valve body 510 having a valve end 520 and a plug end 430. Valve end 520 has an umbrella valve disc that extends across and covers a valve cavity 522 with multiple radially spaced struts 525 that concentrically surround an opening at the end of the longitudinally extending bore of the venturi assembly 420. A stem 528 extends axially between and connects facing surfaces of the valve and plug ends 520, 530 of the valve body 510. In another embodiment, unlike the embodiments shown in FIGS. 46-51, the valve body 510 has a valve end 520 that is devoid of the umbrella valve disc. In other words, the end of the this valve body 510 that is positioned furthest inside of the length of the venturi assembly 420 has the end surface of stem 528 interfacing with the opening at the end of the bore extending through the outlet segment 458 of the venturi assembly 420, shown in phantom by the dashed line representing the end surface of stem 528 shown in FIG. 49.

Referring now to FIGS. 46-50, alignment fingers 535 extend radially from an inner portion of the plug end 520 which is nearest the stem 528. Ends of the fingers 535 abut an inner circumferential surface of the nozzle housing, retaining the plug end in concentric alignment therein. Multiple ribs 538 extend longitudinally along and radially out from an outer portion of the plug end 520 which is nearest a mixing chamber positioned adjacent and upstream of the nozzle outlet. The ribs 538 provide clearance between the plug end 520 and the nozzle housing so that fluid flowing through the nozzle is forced through radially extending passages, into the mixing chamber and then out of the nozzle outlet.

III. System Use

In view of the above and referring again to FIG. 1, to use the dispensing device 10, a user determines the desired end use product and then selects a corresponding container body 105, 110, 112, 114, 116 that has a concentrate "C" of such end use product. For example, the user can install a single container body 105 into the dispensing device 10 or rotate a container assembly 100 so that the desired container body 110, 112, 114, 116 faces forward, aligning the respective outlet assembly 400 with the pump outlet tubing 84.

The user actuates trigger 30 which draws diluent "D" from reservoir 50 into and through the manual pump assembly 35. The diluent "D" is forced out of the manual pump assembly 35 and directed to the outlet assembly 400 by way of the pump outlet tubing 84. The diluent then flows through the outlet assembly 400, gaining velocity and dropping pressure as it passes through the venturi portion 450. In response to the dropping pressure of diluent "D" within venturi portion 450, concentrate "C" is drawn from the container body 110, 112, 114, 116, through the dip tube and into the venturi portion 450. In the venturi portion 450, the diluent "D" and concentrate "C" mix with each other, creating the end use product. The end use product exits the dispensing device 10 through nozzle 460.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept.

Moreover, the individual components need not be formed in the disclosed shapes, or assembled in the disclosed configuration, but could be provided in virtually any shape, and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements. Expedient embodiments of the present invention are differentiated by the appended claims.

What is claimed is:

1. A container for holding a concentrated chemistry within a dispenser that dispenses a diluted volume of the concentrated chemistry, the container comprising:

a front wall that faces outwardly when the container is mounted to a housing of the dispenser and includes upper and lower portions that taper inwardly toward a waist segment defined therebetween, wherein the waist segment is narrower than the top and bottom portions;

upper and lower walls extending from the upper and lower portions of the front wall, respectively;

a locking receptacle extending into each of the upper and lower walls;

wherein an upper locking receptacle extends into the upper wall and defines a semi-circular perimeter shape when the container is viewed from a front elevation;

wherein a lower locking receptacle extends into the lower wall and includes a ramped surface that extends angularly into the lower wall of the container; and further comprising a channel extending angularly between a back wall of the container and the lower wall of the container.

2. The container of claim 1, wherein the upper locking receptacle extends through the front wall and the lower locking receptacle extends through a back wall of the container.

3. The container of claim 1, further comprising a panel that extends from the front wall, wherein the panel is relatively flatter than the remainder of the front wall.

4. The container of claim 1, further comprising an inner support extending in a transverse direction between the front wall and a back wall of the container, wherein the inner support maintains the front and back walls a generally constant distance from each other.

* * * * *